US005253799A

United States Patent [19]

Sebesta

[11] Patent Number: 5,253,799

[45] Date of Patent: Oct. 19, 1993

[54] HIDDEN LOCKING TAB AND SLOTTED FLAP SYSTEM FOR MULTI-SIDED PACKAGES

[76] Inventor: Edward H. Sebesta, 1502 Seevers Ave., Dallas, Tex. 75216

[21] Appl. No.: 585,613

[22] Filed: Sep. 20, 1990

[51] Int. Cl.[5] ..... B65D 5/10

[52] U.S. Cl. ..... 229/108; 229/109; 229/110; 229/115

[58] Field of Search ..... 229/101, 103, 8, 195, 229/108, 115; 40/312; 206/459, 457

[56] References Cited

U.S. PATENT DOCUMENTS

| | | | |
|---|---|---|---|
| 1,292,188 | 1/1919 | Wheeler | 446/488 |
| 1,768,164 | 6/1930 | Sternheimer | 229/302 |
| 1,953,192 | 4/1934 | Rossiter | 229/302 |
| 2,633,657 | 4/1953 | Warren, Jr. | 229/8 |
| 2,964,233 | 12/1960 | McFarland | 229/302 |
| 3,023,944 | 3/1962 | Roth | 229/8 |
| 3,032,254 | 5/1962 | Wilson | 229/8 |
| 3,161,343 | 12/1964 | Paige | 229/192 |
| 3,512,702 | 5/1970 | Pritchard, Jr. | 229/302 |
| 3,563,374 | 2/1971 | Lund et al. | 229/116 |
| 3,668,796 | 6/1972 | Patterson | 229/8 |
| 3,868,295 | 2/1975 | Boone, Jr. | 52/82 |
| 4,155,446 | 5/1979 | Aronson | 206/459 |
| 4,172,549 | 10/1979 | Yoshida | 229/8 |
| 4,380,133 | 4/1983 | Arnstein | 446/488 |
| 4,517,251 | 5/1985 | Mosely | 446/488 |
| 4,620,842 | 11/1986 | Wang | 446/488 |
| 4,678,095 | 7/1987 | Barnett et al. | 229/114 |
| 4,742,915 | 5/1988 | Ringer | 206/459 |
| 4,986,464 | 1/1991 | Leigh | 206/459 |

FOREIGN PATENT DOCUMENTS

| | | | |
|---|---|---|---|
| 2225542 | 6/1990 | United Kingdom | 446/488 |

*Primary Examiner*—Allan N. Shoap
*Assistant Examiner*—Christopher J. McDonald
*Attorney, Agent, or Firm*—Ross, Howison, Clapp & Korn

[57] ABSTRACT

A system for construction of a multi-sided solid shaped carton, package, or similar multi-sided structure including a flat blank having multiple polygon shaped faces, each face hingably connected to at least one other face, having free edges of the faces connectable to free edges of other faces to form a multi-sided carton, a first edge forming element for connecting a first pair of free edges with a first degree of holding force, and a second edge forming element for connecting a second pair of free edges with a second degree of holding force which is greater than said first degree of holding force. A unique symbol code is used for drawing attention to the preferred starting point of construction, for designating the appropriate correspondence between tab and slotted flap edge forming elements, and for designating the preferred order of assembly.

45 Claims, 21 Drawing Sheets

HIDDEN LOCKING TAB AND SLOTTED FLAP SYSTEM FOR MULTI-SIDED PACKAGES

BACKGROUND OF THE INVENTION

This invention relates to multi-sided packages and, in particular to a system of hidden locking tabs and slotted flaps for constructing multi-sided or polyhedral shaped packages, cartons or similar structures from blanks or flat sheets of stiff material formed with cuts and score lines defining polygon shaped faces.

PRIOR ART

Multi-sided or polyhedral shaped boxes have been popular for a number of years as decorative items and as entertaining construction projects for children and adults alike. Typically geometrical shapes including polyhedra are only available through complex assembly. Instructions and guides for such assembly is typically inadequate. In most cases glues, adhesives, tape, staples or rivets are required. The resulting solid shape commonly has broken surface folds at the edges. The types of final assembled shapes resulting are generally restricted to what is considered "mathematically important". Examples of previously known solid shapes and constructions are demonstrated in "Make Shapes—19 Mathematical Models to Cut Out, Glue and Decorate" by Gerald Jenkins, Anne Wild and Wilson Smith, published by Tarquin Publications (Series No. 1); "Make Shapes—8 Mathematical Models to Cut Out, Glue and Decorate" by Gerald Jenkins, Anne Wild and Wilson Smith, published by Tarquin Publications (Series No. 2); and "Make Shapes—3 Mathematical Models to Cut Out, Glue and Decorate" by Gerald Jenkins, Anne Wild and Wilson Smith, published by Tarquin Publications (Series No. 3). After construction the shapes are static and cannot be given functionality beyond the decorative appearance. Storage, transport and handling of the shapes in the final full, solid form is difficult as they are not collapsible after assembly for compact transport and storage.

Various shapes for cartons are generally limited to box shapes such as the fruit box disclosed in U.S. Pat. No. 495,421 to Meech in 1893, the rectangular box or carton with locking means disclosed by Paige, U.S. Pat. No. 3,161,343 issued Dec. 15, 1964, and the playing card dispenser disclosed in U.S. Pat. No. 3,301,388 issued to Rockwell, Jan. 31, 1967. These patents various tabs insertable into slots to facilitate partial assembly of relatively simple shapes cartons or boxes. The disclosed constructions have various drawbacks including, for example with respect to the Meech patent, slots which are spaced apart from the corner so that a partially overlapping construction results on the exterior face of the carton rather than a sharp crisp creaseline at each exposed exterior edge or corner of the multi-sided shape. Further, the carton as disclosed in the Meech reference and also as disclosed in the Paige reference, fails to fasten all of the edges together and the Meech lid is hingably fastened only at one hinged scoreline and at one opposed edge with a tab. Four of the edges of the hexagon-shaped lid remain unsecured. The Paige box does not provide an integrally formed lid.

The playing card dispenser disclosed in Rockwell requires at least some adhesive fastening along edge 21 at flap 20 of FIG. 3.

Other multiple sided cartons or packages are disclosed in U.S. Pat. No. 3,175,683 issued to Billing, Mar. 30, 1965 in U.S. Pat. Nos. 3,531,043 and 3,563,374 issued to Carlsson, Sep. 29, 1970 and Feb. 16, 1971, respectively, in U.S. Pat. No. 4,064,662 issued to O'Toole Dec. 27, 1977. All show multi-sided structures which are assembled using glue adhesive or rivet connectors other than tabs and slots.

There have been numerous other attempts to provide polygonal containers in which adhesives, glue, rivets or other externally provided fastening operations are required. Examples include U.S. Pat. Nos. 3,633,818, 4,205,775, and 4,678,095, each of which requires gluing along at least one edge. Also, U.S. Pat. No. 4,682,726 requires fastening as by a rivet along various edges. Similarly, U.S. Pat. No. 2,969,903 requires gluing.

Some limited attempts to provide polygonal shaped boxes or cartons without gluing have been made. But each has various other disadvantages and drawbacks. For example, U.S. Pat. No. 2,819,833 issued to Sauer, Jan. 14, 1958 discloses a polygonal paperboard box which comprises parallel octagon-shaped top and bottom hingably connected through at least one side panel and having overlapping side panels and flaps forming eight vertical sides interconnecting the parallel top and bottom. Additional locking flaps are provided on four of the side panels so that they may be tucked in at equally spaced locations around the octagon adjacent an edge of the octagon. It is the particular form of this paperboard box, (i.e., two parallel top and bottom even sided polygons interconnected with multiple vertical side panels), which permits using the tucked tabs for locking the structure. This construction is not easily adaptable to shapes other than those having two parallel opposed polygons and other than those polygons having an even number of sides so that the particular alternating overlapping flap, tucked tab, overlapping flap, tucked tab system is useful.

Another non-glued solid shape was disclosed in U.S. Pat. No. 4,362,266 issued to Webinger, Dec. 7, 1982. Again, the Webinger patent discloses a construction usable with a particular shape, i.e., one having a hexagon-shaped base and a larger hexagon-shaped lid parallely disposed with tapered trapezoid-shaped panels. This construction requires alternating ones of the trapezoid shaped panels to have a mirror image trapezoid flap to which a projecting tab is rigidly attached. Slots are formed at the hingable scorelines to which the trapezoid flaps are attached to the hexagon shaped base so that the non-bendable tabs projecting from the mirror image trapezoid flaps can be inserted into the slots upon bending the flap 180° so that a double thickness trapezoid side portion is formed. Additional slots are formed at the hinged line connecting the trapezoid side portion to the mirror image trapezoid flap which slots receive overlapping tabs both from overlapping corner flaps between the trapezoid side portions and also tab portions hingably connected to alternating ones of the top hexagon shape. While this complex structure results in a multi-sided box for the one particular shape shown, it does not present a system conveniently usable for the construction of any of a variety of multi-sided box structures including polyhedral structures. Further, there is no suggestion in the Webbinger patent of a system by which the interconnection of the various tabs into the appropriately corresponding slots can be easily followed and understood by a person without box construction training.

One attempt to provide a blank for constructing solid forms without the use of glue and for constructing many geometric forms or solids was presented in U.S. Pat. No. 3,666,607 issued to Weissman, May 30, 1972. The Weissman patent disclosed the use of hermaphroditic connectors along each free edge of each polygon panel of the polyhedral shape. Thus, each free edge was provided with a first male tab member and a first flap with a slot therein and each opposed free edge for connection therewith had the reverse image, i.e., a second flap with a slot for receiving the first tab and a second tab for insertion into the first slotted flap. Weissman teaches that it is advantageous to provide consistently rigid connections at each free edge. The patent was directed to forming solid shapes which could be connected one to another thereby constructing a larger, more complex solid form. The Weissman construction is therefore inappropriate for making multiple shapes which can be used as packages or cartons. It has the disadvantage of not providing for easy opening of the solid form at a given one of the panels or at a given group of the panels acting as a unit. Thus, the solid forms constructed according to Weissman do not lend themselves for openable cartons, packages or gift boxes and the like. Further, Weissman fails to disclose a system of coding the tabs and slotted flaps to be interconnected with each other for ease of construction by the user.

Thus, it is an object of the current invention to overcome the various deficiencies and drawbacks of the foregoing described references and patents by providing blanks for construction of many geometrically shaped cartons or packages without the use of glue. It is another object to provide a complete system of tabs and slotted flap designs which provide varying degrees of holding power and varying degrees of ease of assembly to accommodate construction of many multi-sided geometric solid shaped packages which both have substantial holding capability to hold other objects therein and also have sufficiently easy access through one or more of the panels which can be opened and re-closed by the user. It is also an object to provide an advantageously simple code system for identifying the tab and slotted flaps which are to be interconnected during construction of complex geometric figures and also to conveniently indicate a desirable, beneficial and efficient order of assembly. It is further an object of the invention to uniquely apply the inventive tab and slotted flap system and the unique assembly code to multiple geometric shapes including both mathematically significant polyhedra and also nonstandard geometric shapes.

BRIEF DESCRIPTION OF THE DRAWINGS

These and other objects and advantages of the invention will be better understood with reference to the following drawings in which like numerals represent like elements and in which.

BRIEF SUMMARY OF THE INVENTION

Figure 1:
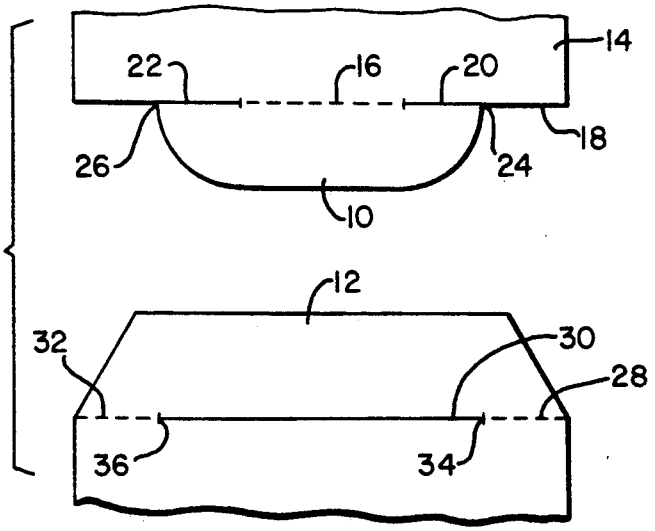
FIG. 1 is a schematic plan view of a typical non-locking tab and corresponding slotted flap according to the present invention.

A system is disclosed and taught for constructing multi-sided or polyhedral-shaped cartons or packages and the like without the use of adhesive connectors along the edges. Each solid shaped carton is advantageously made from a single flat blank of stiff planar material forming multiple polygonal-shaped face panels, each panel hingably connected to at least one other panel along a straight score line or crease line in the flat blank. Crisp, unbroken edges are formed along the edges of the multi-sided or polyhedral shaped cartons or packages using fastenable edge forming tabs and corresponding slotted flap elements on the free sides of the polygonal shaped panels which free sides are not hingably connected with score lines. A unique and preferably redundant system of printed symbols is placed on the tabs and corresponding slotted flap elements for designating which tabs and flaps are to be interconnected and also to conveniently indicate a desirable order of convenient assembly.

To beneficially facilitate the construction of the various polyhedral shaped cartons in a manner which permits them to be used as openable and closable cartons for containing accessible materials such as candy or gift items and the like, a system of tab and slotted flaps having varying degrees of holding power, varying degrees of ease of assembly, and varying degrees of ease of disassembly is disclosed.

DETAILED DESCRIPTION OF THE PREFERRED EMBODIMENTS

The invention also relates to the use of tabs and slotted flaps for the construction of various multi-sided solid shaped cartons or packages. Examples of the wide range of shapes for which the invention is applicable include tetrahedron, icosahedron, rhomboid, octohedron, truncated tetrahedron, faceted pyramid, bent pyramid, chevron, anti-prism, N-general trapezahedron, generalized triangular pyramid, intersecting pyramids, intersecting regular pyramids, decadeltahedron, pentagonal pyramid, dodecahedron, cube with square pyramids on each face, trapezohedron, square pyramid, truncated octahedron, rhombicuboctahedron, and to certain new shapes with the following names as coined by the inventor: hexagonal tower box, pentagonal tower box, ammonite box, twisted pentagonal pyramid, star pyramid, pseudo-ammonite, vertex (cathedral box), vertex tower boxes (cathedral), gothic box, spiral tower, and Egg I.

The tabs and slotted flaps used according to this invention and for the construction of various figures are completely hidden from view after final construction. The creases between the polygon-shaped faces and the creases at the free edges at which the tabs and the slotted flaps are connected allow an edge without an uneven or broken surface. The exterior of the shape shows faces and straight even edges since the designs of the blanks are fixed in the manufacture, the result is the same regardless of the skill of assembly, and requires no understanding of geometry or ability to construct shapes. Thus, there are advantages for giftwrapping and package formation. While many people cannot wrap a package, they would, with sufficient time, be able to construct any of the shapes and they would achieve substantially the same result as a person with extraordinary manual skill. The skillful individual may complete the task quicker but with no greater perfection of results.

The set or system of tabs and slotted flaps having different design for various strengths and various degrees of ease of assembly. For each shape a subset of the family of tab and flap designs is used to meet the different needs of the particular shape. For any given shape a different tab and slotted flap designs can be used to give different functionality for different applications. For example, greater or lesser ease of assembly can be achieved, greater or lesser strength for carrying objects is obtainable, and greater or lesser accessibility or openability of one or more of the facets of the package can be accomplished.

Many shapes can be constructed according to the invention which are pleasing and geometric, but which are not of substantial mathematical or academic importance. The complete system of tabs and flaps is useful in construction of a very wide range of shapes according to the present invented designs. Such variety of shapes and packages can be assembled from flat sheets or blanks appropriately constructed with tabs and slotted flaps and with score lines at which the blanks can be bent.

The blanks or flats can be stored and transported compactly. After use or when necessary they can be easily dissassembled and again stored or transported in a flat configuration.

The tabs and the corresponsing flaps into which they are to be inserted are correspondingly numbered. Both to indicate which tabs are to be inserted into which flaps and also to indicate the order in which the assembly can be conveniently or easily accomplished. Preferably, the most desirable order for the particular purpose is indicated. Further, along with a numeral a written word number is provided so that there can be no mistake as to the order of assembly intended. Also, it has been found to be advantageous to provide various ones of the tabs and flaps to be interconnected with corresponding printed patterns, designs or colors to further facilitate prompt understanding of the assembly. In particular, it has been found to be advantageous to designate, with color coding or other symbolic patterns or designs, those tabs and flaps which are greatly spaced apart or at opposite ends of the blank. This is particularly beneficial for the understanding, ease, and quickness of assembly by individuals without extensive geometric knowledge. In particular, it has also been found to be advantageous to code with distinctive patterns or colors the starting tabs and flaps, as it often becomes self evident as to the correspondence between tabs and flaps once the preliminary stages of construction are started.

Figure 2:
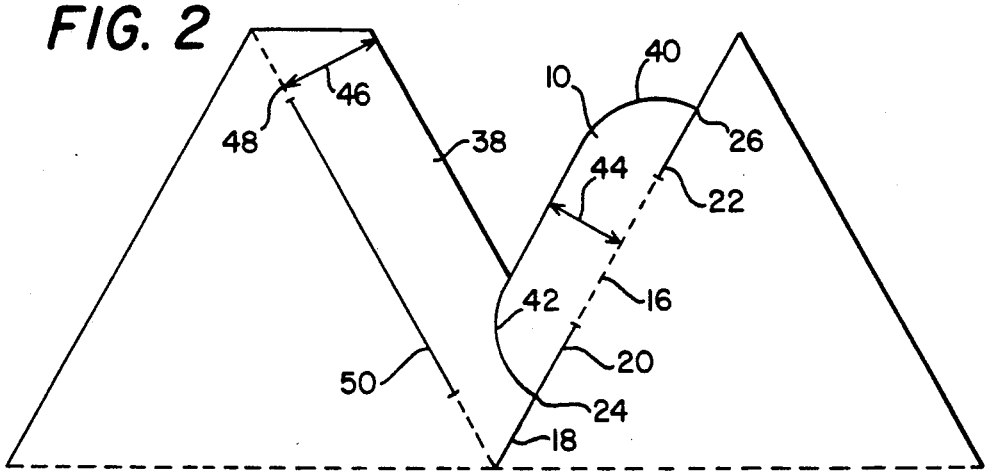
FIG. 2 is a schematic plan view of a non-locking tab and corresponding slotted flap positioned at a corner juncture between two polygon-shaped faces according to the present invention.

With reference to FIG. 1 which is a schematic depiction of a non-locking tab 10 and slotted flap 12 it will be seen that tab 10 is hingably connected to the free edge of geometrically shaped panel 14 or polygon face 14 along a crease line 16 or score line 16. The free edge 18 of polygon 14 may be advantageously continued with cut portions 20 and 22 along and colinear with crease 16 to a distance inward from terminal ends 24 and 26 of tab 10. Flap 12 is hingably connected along score line 28 (as indicated by dashed lines). For the purpose of receiving tab 10, a slot 30 is formed in flap 12. Slot 30 may be advantageously formed with a single cut colinear with crease line 28 and having ends 34 and 36, which ends are therefore immediately adjacent to and colinear with fold lines 28 and 32 on either side thereof. Slot 30 terminates at ends 34 and 36 which correspond in location to the desired assembled location of ends 24 and 26 of tab 10. Thus, the distance between ends 34 and 36, i.e. the length of slot 30, corresponds to the distance between ends 24 and 26 of tab 10. Advantageously, with the use of precision cutting, the distance between 34 and 36 is made slightly longer than the distance between 24 and 26 to more easily accommodate the thickness of the tab 10 during insertion. However, for greater holding power with a non-locking tab and slotted flap, the distance between the ends 24 and 26 of tab 10 can be made greater than or equal to the distance between the ends 34 and 36 of slot 30.

Where two polygonal faces of a solid form will meet at the corner, a non-locking tab and flap arrangement, as shown in FIG. 2, can be advantageously employed. In this case the tab 10 is constructed in a manner similar to that of tab 10 in FIG. 1 and flap 38 is generally constructed similar to that of flap 12 in FIG. 1. However, it has been found that where there are acute angles, the material of a single flat sheet from which the blank is to be cut will result in the tab 10 and flap 38 overlapping. In that event, a non-locking tab 10 as shown in FIG. 2 is formed with ends 24 and 26 and easily insertable curved ear portions 40 and 42. Any overlapping flat sheet material required to form ear portion 42 is simply removed from flap 38. Thus, the distance 44, by which tab 10 projects from hinge line 16, is substantially equal to the distance 46, by which flap 38 extends from its hinge line 48. This distance can be maintained, during design and cutting of the blank, sufficiently long to allow easy manual manipulation yet still provide for sufficient material strength for proper connection during assembly of the solid shaped carton. It has been discovered that this arrangement uniquely allows for the construction of tabs and slotted flap devices even at angularly disposed interconnecting free faces of the polyhedral shapes.

It is noted that in each of the schematic figures fold lines are indicated with a broken line and cut lines are indicated with solid lines. Thus, the distance between cut ear portion 42 of tab 10 and the slot cut 50 of flap 38 must merely be maintained a sufficient distance so that tearing does not result under ordinary tension conditions. Thus, for example with cardboard sheet stock which is approximately 0.025" (1 mm) thick, a minimum distance between slot 50 and ear 42 of approximately 0.25" (0.6 cm) is typically adequate.

Figure 3:
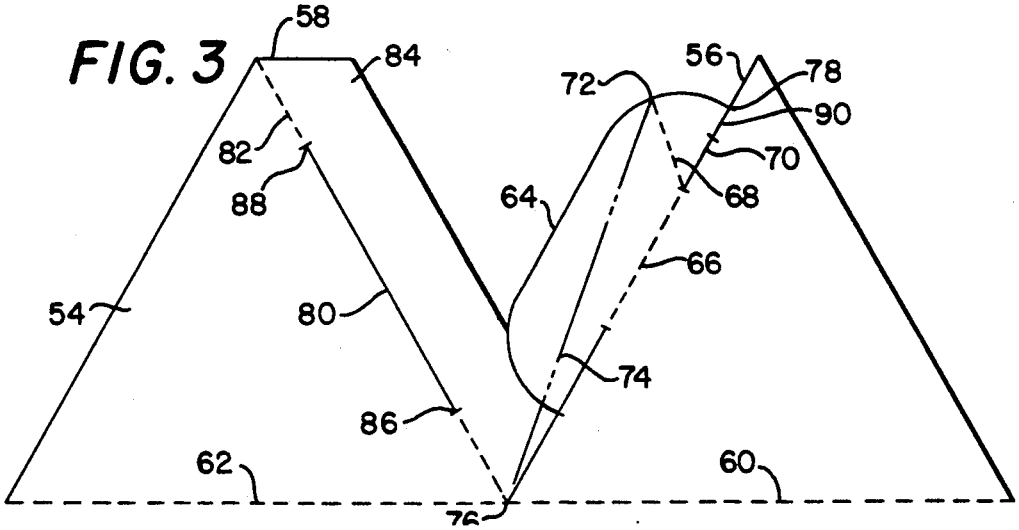
FIG. 3 is a schematic plan view of an angle locking tab and corresponding slotted flap positioned at a corner juncture of two polygon-shaped faces according to the present invention.

A tab and slotted flap locking device design which provides greater locking strength than the non-locking tab and flap yet which is easy to assemble is shown in FIG. 3 and has been referred to characteristically throughtout this application as an "angle locking" tab and flap device.

The angle locking tab and slotted flap arrangement shown in FIG. 3 according to the present invention is slightly more difficult to assemble than the non-locking tab and flap device of FIGS. 1 and 2. It will be noted that the tab and flap design is shown schematically in a plan view. The polygon faces 52 and 54 have free edges 56 and 58 angularly disposed with respect to each other. The crease or fold lines 60 and 62 of polygon panel faces 52 and 54 constitute the "non-free" edges at which the faces are to be hingably bent with respect to the remainder of the polygon-shaped panels used to form the multi-sided solid carton or package according to the invention.

Unique features of the angle locking tab 64, which is hingably connected to panel face 52 at crease line 66, lies, in part, in the fold line 68 which is at an angle from the terminating end of cut line 70 and extends outwardly to the rounded ear 72 of tab 64. This configuration allows the end portion of ear 72 to be folded 180° so that it is flat against tab 64. Fold line 68, which is typically formed with a crease or a score or other means, terminates on the exterior of tab 64 so that its radius 74 is smaller than the distance from corner 76 to the end 78 of ear 72. A slot 80 is cut along the hinge line 82 by which flap 84 is attached to polygon surface 54. Slot 80 terminates at ends 86 and 88. The end 88 of the cut is located a distance from the corner 76, which distance is substantially equal to the radius 74. Thus, the ear 72 can be folded upon tab 64 so that the tab 64 can then be inserted into slot 80. Then ear 72 is allowed to pivot outwardly thereby forming an overlap between end 78 of tab 64 and crease line 82. The overlap is immediately adjacent the end 88 of slot 80. It will be seen that this angle locking tab and slotted flap arrangement provides for greater holding power than the non-locking construction of FIGS. 1 and 2 because of the projection of end 78 beyond cut end 88. The overlap is not so great that substantial difficulties arise in assembly. Further, disassembly is not entirely thwarted, as the "give" or flexibility of most stiff sheet materials used in package construction will allow tab 64 to be withdrawn when a significant but not overwhelming amount of outward tension is applied.

It has been found that angle locking tab and flap arrangements can be used in situations other than polygon edges which are located at adjacent corners, as for example in situations where remote or separated edges are to be connected. However, the additional holding power of an angle locking configuration is primarily at one end of the tab. Thus, the angled locking tab and flap arrangement is particularly advantageous when used in connection with a corner connection arrangement because of the additional leverage provided at the exterior end rather than the interior end of tab 64.

Figure 4:
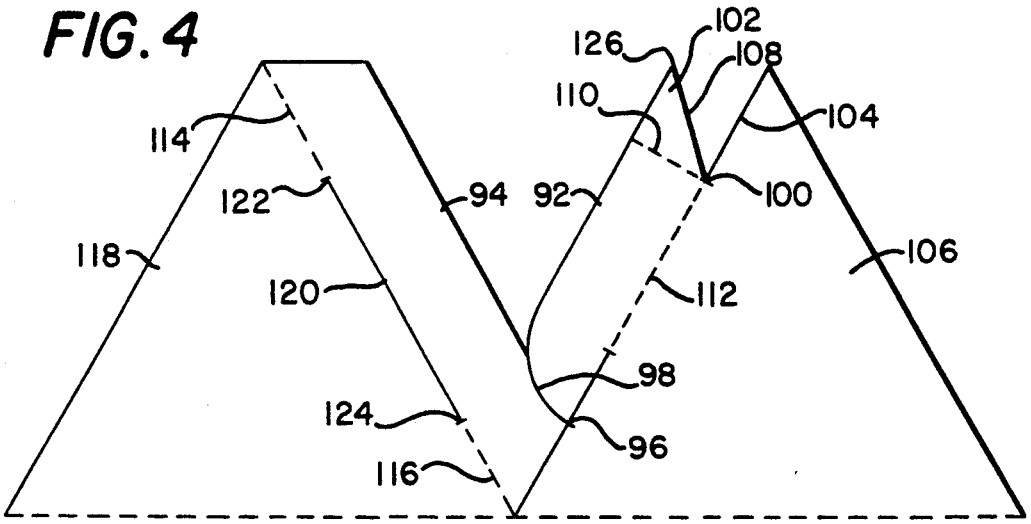
FIG. 4 is a schematic plan view of a hard locking tab and corresponding slotted flap positioned at a corner juncture of two polygon-shaped faces according to the present invention.

Another tab and flap arrangement which has special utility at corner connections between polygon faces of the intended polyhedron or multi-sided shaped package or carton is shown in FIG. 4 which is a schematic plan view of a "hard locking" tab 92 and slotted flap 94. In this arrangement one end 96 of tab 92 has a rounded ear portion 98 while the opposite end 100 is provided with a triangular shaped ear portion 102. Free edge 104 of polygon panel 106 is cut up to corner 100 and ear 102 is formed by an angular cut 108. A crease line 110 is formed on tab 92 perpendicular to cut 104 and to hingable connection score line 112 so that ear 102 can be folded with respect to tab 92. Slotted flap 94 is hingably connected at 114 and 116 to polygon panel 118. Colinear with hingable connection 114 and 116 is slot 120 formed by cutting along crease line 114 and 116 from end 122 to end 124. The length of the slot 120 is substantially equal to the distance between end 96 and end 100 of tab 92, such that upon folding ear 102 so that it is flat against tab 92, the entire tab 92 can be easily inserted into slot 120. Upon insertion, ear 102 is then unfolded such that there is direct interference between cut edge 108 and corner 122 of slot 120. This forms a hard lock. Any attempt to extract tab 92 from slot 120 causes cut edge 108 to engage slotted flap 94 at corner 122 of slot 120. Continued attempts to extract the tab 92 cause deeper embedding and will result in locking to the fullest extent of the strength or resistance to tearing of tab 92. It will be noted that the angle of cut 108 with respect to free edge 104 determines to some extent the projection of ear 102 beyond fold line 110 and therefore has some effect on the strength of holding of the hard locking tab 92. Typically it is advantageous to have hingable connection 112 substantially longer than fold line 110, generally about two to three times as long. Also, the exterior most corner 126 of ear 102 will preferably not project beyond the end of free edge 104 so that there will be clearance for ear 102 to be unfolded when the polyhedral construction is fully assembled.

Figure 5:
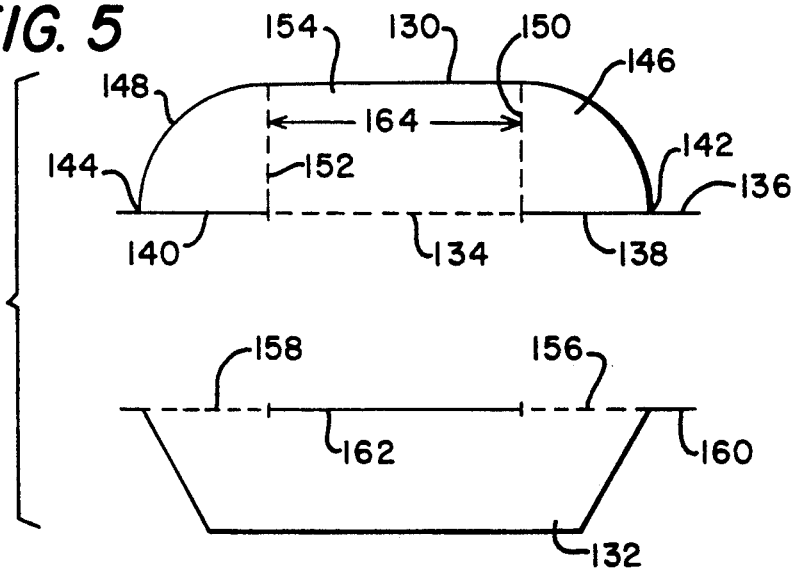
FIG. 5 is a schematic plan view of a forced tab and corresponding slotted flap according to the present invention.

In situations during the construction of polyhedral shapes where two distant or spaced apart free edges of polygon panels are to be connected it is beneficial to use a "force" tab and slotted flap as shown in FIG. 5. This design provides a strong tab and slotted flap device which has evenly distributed holding power on each edge of the tab and slotted flap. Some of the specific applications will be more fully understood with reference to the particular blanks shown in FIGS. 15–31. An alternative design for a "forced" tab and slotted flap assembly is depicted in FIG. 6.

FIG. 5 is a schematic plan view of the forced tab 130 and corresponding slotted flap 132. The tab and flap are shown directed away from one another as they may be on opposite ends of the blank sheet from which the polyhedral shaped box or carton may be constructed. Thus, fold line 134 connects tab 130 to a free edge 136 of a polygon panel. Free edge 136 extends, as by cuts 138 and 140, inward from each of its ends 142 and 144, respectively. Flap 130, in the embodiments shown in FIG. 5, has curved ear portions 146 and 148 which are foldable along score lines 150 and 152, respectively. Fold lines 150 and 152 project generally perpendicular to free edge 136 and extend from the inward ends of cuts 138 and 140 outwardly to the distal end 154 of tab 130. Slotted flap 132 is constructed so that it is hingably connected at score lines 156 and 158 which are colinear with free edge 160. A slot 162 is formed, as by cutting, colinear with and interposed between score lines 158 and 156. The length of cut 162 corresponds to the distance 164 between fold lines 150 and 152 of corresponding tab 130. Again, as the ears 146 and 148 will be folded flat against tab 130 when it is to be inserted into slot 162, the length of slot 162 will preferably be slightly greater than the distance between 150 and 152 to accommodate the extra thickness. After insertion, ears 146 and 148 will be unfolded thereby providing a rigid or forced lock against the underside of score lines 156 and 158, respectively. This type of forced tab has particular advantages in construction of polyhedral shapes as a starting connector. There is sufficient room at the initial stages of assembly for manipulation of the folded ears so that the ears can be folded, inserted, and unfolded. Also, as the initial connection or connections form a "foundation" for the rest of the structure it is desirable for such initial connections to be strong as with the force tab and slotted flap. There is also sufficient room for disassembly in reverse order when the polyhedral structure is to be put in a flat condition for storage or transport.

Figure 6:
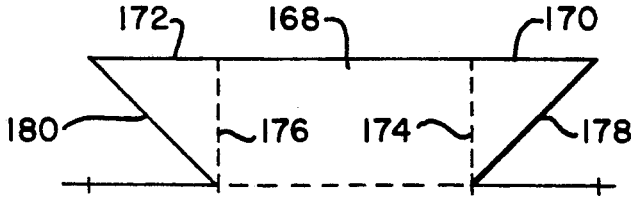
FIG. 6 is a schematic plan view of an alternative design for a forced tab usable with a corresponding slotted flap as in FIG. 5 according to the present invention.

FIG. 6 shows an alternative design of a forced tab 168 which forced tab design uses the same general principle of folding ears 170 and 172 along score lines 174 and 176 so that the tab can be inserted into a slotted flap such as 132 of FIG. 5. Again the length of the corresponding slot 162 is such that the distance between 174 and 176 is substantially equal to the length of slot 162. It will be noted that this alternative design of FIG. 6 is slightly harder to insert than the design of FIG. 5 because it does not have curved ear portions as 146 and 148 of flap 130. The alternative design of FIG. 6 is also slightly easier to extract because of the angled cut surfaces 178 and 180.

Figure 7:
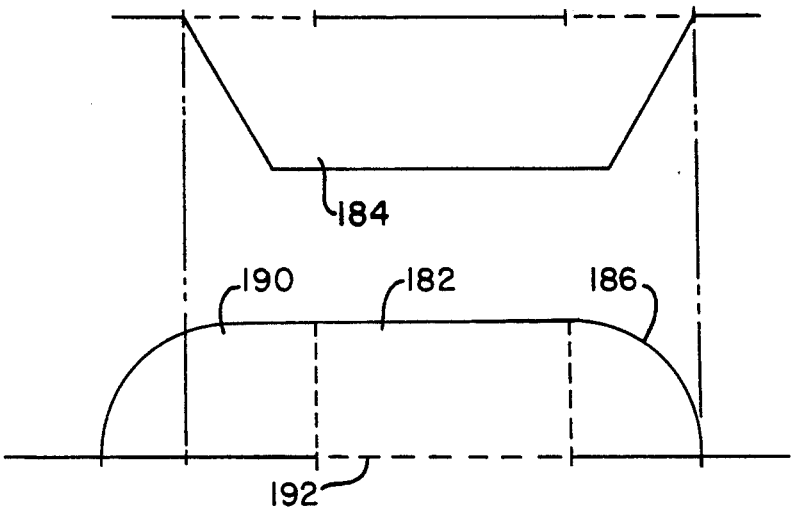
FIG. 7 is a schematic plan view of an extended forced locking tab and corresponding slotted flap according to the present invention.

An additional variation of forced tab and slotted flap configuration is shown in FIG. 7 which is a plan view of an "extended tab" 182 for interconnection with a slotted flap 184. It will be noted that tab 182 has one of its ears 186 substantially identical to ear 146 of the tab 130 in FIG. 5 while the opposed ear 190 is longer than ear 186 so that after folding ear 186, ear 190 can be folded and overlaps ear 186. Thus, both ears are held in place with a single finger or thumb during assembly. While the preferred embodiment is shown with ear 190 longer than ear 186, a similar overlapping effect can be achieved where both ears 186 and 190 are extended equally or in any combination of lengths such that the combined length is longer than the length of hinge 192. It will further be noted that the extended forced locking tab in the preferred configuration shown in FIG. 7 is one with rounded ears 186 and 190. These could also be triangular shaped ears similar to those of FIG. 6 provided the triangular ears are sufficiently long so that they overlap when folded inwardly upon the tab for insertion.

Figure 8:
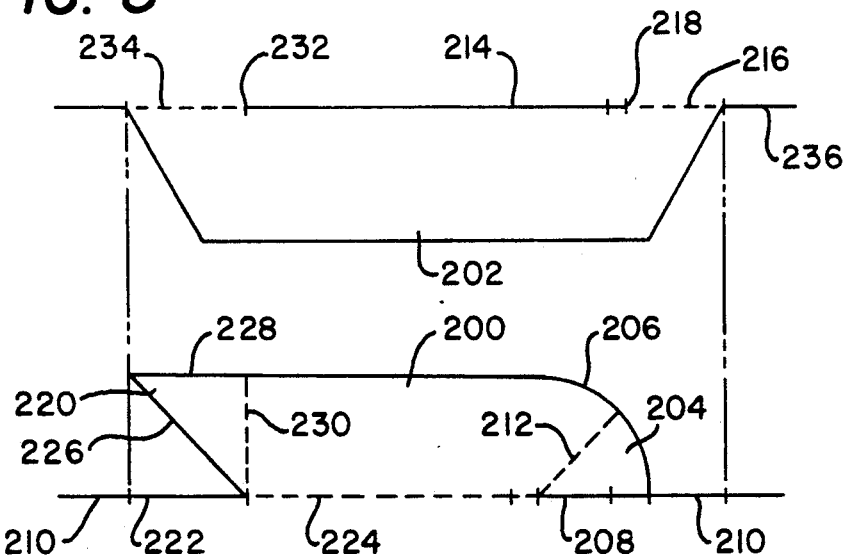
FIG. 8 is a schematic plan view of an example showing that, in general, specific types of tab and flaps can be combined into a single hybrid tab and corresponding slotted flap, in the specific example depicted the tab and slotted flap incorporates both a hard locking and an angle locking structure according to the present invention.

It has also been found that in certain situations it is important to have varying degrees of holding strength from one side of the tab to the other. In those situations it is advantageous to provide a hybrid tab and slotted flap device in which an angle locking ear construction is used in combination with a hard locking ear construction on the same tab and flap. One example of an embodiment of a hybrid tab and slotted flap is shown in FIG. 8 which is a schematic plan view of a tab 200 and corresponding slotted flap 202. The tab 200 has formed thereon one ear 204, which ear 204 is formed with a curved cut portion of the tab 206 a cut 208 extending along the free edge to 210 and at an angularly disposed fold line 212 such that angle locking ear 204 can be folded 180° with respect to tab 200. On the opposite side of tab 200 is a hard locking triangular shaped ear 220 formed with cut 222 extending along free edge 210 and colinear therewith and with hingable connection 224 and cut 208 on the opposite side of the tab. The ear 220 is further formed with an angled cut 226 projecting outwardly to the end surface or continuation of tab distal end 228. A fold line 230 projects substantially vertically from the corner of cut 222 and 226 outwardly onto tab 200. When ears 204 and 220 are folded with respect to tab 200 it is easily insertable into slot 214 which extends along hingable fold line 216 from one end 218 to another end 232 adjacent hingable connection 234. As with the other tab and slotted flap embodiments previously discussed the hingable connection of both the tabs and the flaps are colinear with the free edges 210 and 236 which are to be interconnected.

Figure 9:
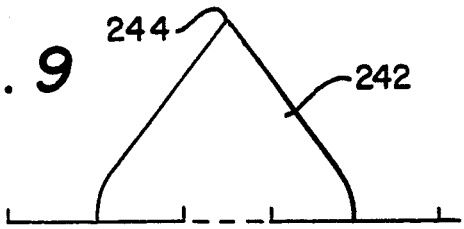
FIG. 9 is a schematic plan view of a non-locking spade tip tab according to the present invention.

In some situations spade tipped tab and flap connections are useful as shown in FIG. 9, which is a plan schematic view of a non-locking spade tab with the flap connector not shown. The spade tabs are very useful and have distinct advantages when a face, typically, if not always the last face of the box to be fitted into place by the tab and flap insertion, requires several tabs and flaps to come together simultaneously. The tip 244 helps to open the slot or slit provided in the corresponding slotted flap for ease of insertion. The tip further holds the flap in place for full insertion and, in particular, allows a multiplicity of spade tipped tabs to be inserted into a corresponding multiplicity of slotted flaps to greatly facilitate the ease of assembly. Often times with multiple edge polygon faces, more than one or two tabs must be inserted at the same time and the spade tipped tab permits a single individual to accomplish this task much more easily than with other designs.

Figure 10:
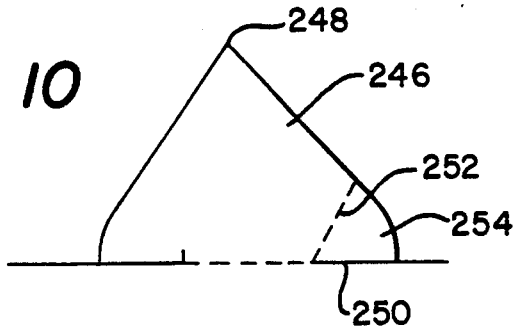
FIG. 10 is a schematic plan view of an angle-locking spade tip tab according to the present invention.

With reference to FIG. 10 which is a schematic view of a spade tipped angle locking tab, it will be seen that the inventive spade tipped tab concept can also be applied advantageously to an angle locking tab 246. Except for the projecting tip 248 the tab construction is similar to that for the previously discussed angle locking tab. Including at least one undercut portion 250 and an angled crease line 252 so that ear 254 can be folded flat against tab 246 for insertion into a slot corresponding to the shortened dimension created by folding ear 254. When ear 254 is returned to its non-folded position, an overlap results thereby giving the tab its "locking" characteristics.

Figure 11:
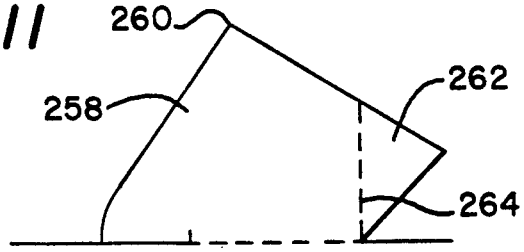
FIG. 11 is a schematic plan view of a hard locking spade tip tab according to the present invention.

FIG. 11 is a schematic plan view of a spade tipped hard locking tab 258. In this embodiment the tab 258 has a shape shaped tip 260. Also, a triangular-shaped ear 262 is hingably connected to tab 258 along crease line 264. Again, the ear 262 is folded flat against tab 28 for insertion and unfolded to create the "hard" lock. The spade shaped tip facilitates easy insertion.

Figure 12:
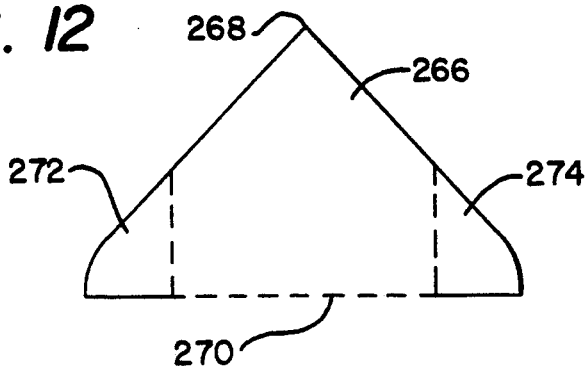
FIG. 12 is a schematic plan view of a forced spade tip tab according to the present invention.

FIG. 12 shows the spade tipped invention applied to a forced tab 266. The tip 268 projects generally away from the hinge line 270. On either side of tab 266 are ears 272 and 274 which are folded flat against tab 266 for insertion into the corresponding slotted flap. It being noted that as discussed previously for the non-spade tipped version of the forced tabs that the corresponding slot will have a length substantially the same as that of hinge connection 270.

From all the foregoing FIGS. 9, 10, 11, and 12, it will be noted that the tips 244, 248, 258, and 268 are generally shown centrally located outward from the hinge connection of the tabs. This does not need to be the case in every instance and in some instance it has been found, depending on the orientation of the tab and corresponding slotted flap on a particular figure when it is being assembled, that the tips may be advantageously off center in one direction or the other to facilitate ease of assembly. This will become more apparent with reference to the following specific examples of various applications of the inventive tab and flap system to specific solid shapes and blank sheets for the construction of such shapes.

It has been found that highly accute angular interconnections adjacent polygon faces or panels can present a problem where there is not sufficient material where between the panels to construct a full-length tab and flap. This problem has been overcome with the development of crevice flaps as shown in FIG. 13.

Figure 13:
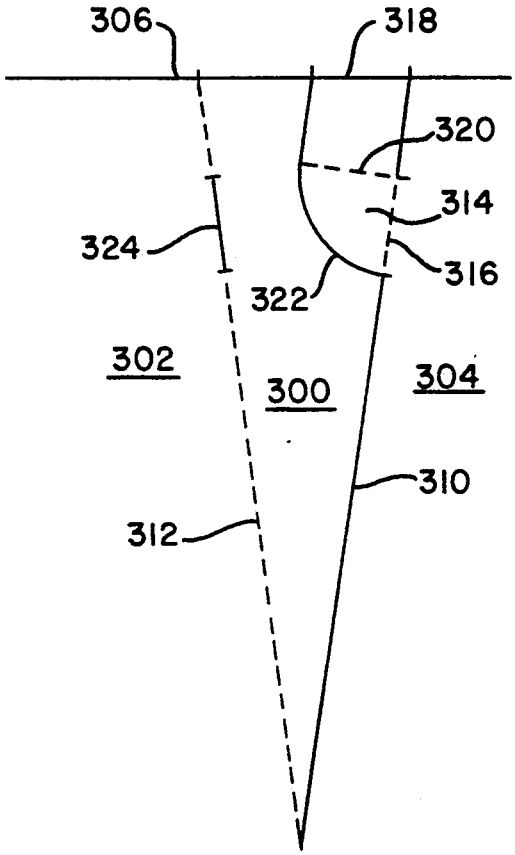
FIG. 13 is a schematic plan view of a crevice tab and slotted flap according to the present invention.

With reference to the crevice flap of FIG. 13 it will be seen that the flap 300 is typically formed with most of the material between adjacent polygon faces 302 and 304. A cut extends from the external free edges 306 and 308 of panels 302 and 304, respectively. Substantially at the acute angle desired on one side with a cut 310 and on the other side with a crease or score line hingable connection 312. Along a distal portion of cut 310 a small tab 314 is formed hingably connected to panel 304 at 316. An ear 318, which is substantially the same length as hingable connection 316, is foldably connected at line 320 to tab 314. Preferrably, tab 314 has a curved external surface 322 and the length of hingable connection 316 corresponds to the length of slot 324 formed along fold line 312. Thus, it can be seen that while this connector is termed a crevice-tab and flap it is substantially similar to one side of a forced tab and flap which is positioned off center away from the apex of the juncture between panels 302 and 304.

Figure 14:
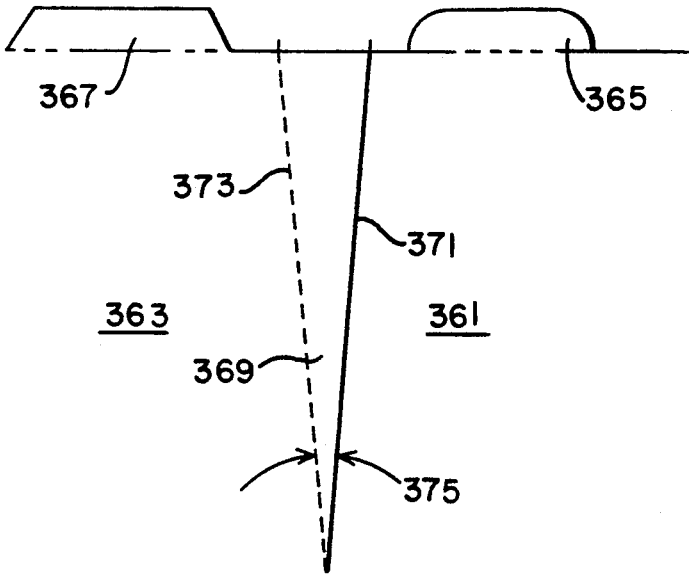
FIG. 14 is a steep angle solo flap according to the present invention.

In some situations where the angle between interconnecting panels is extremely small and where surrounding free edges have sufficiently strong tab and flap connectors, a solo flap may be used as shown in FIG. 14. The solo flap does not include any tab or slotted flap but really relies on the tabs and flaps on adjacent panels 362 and 364 which are shown symbolically as tab 366 and slotted flap 368. Thus, the solo flap 370 is constructed using an angular cut 372 and an angular crease line 374 which an acute angle 376 formed therebetween.

Figure 15:
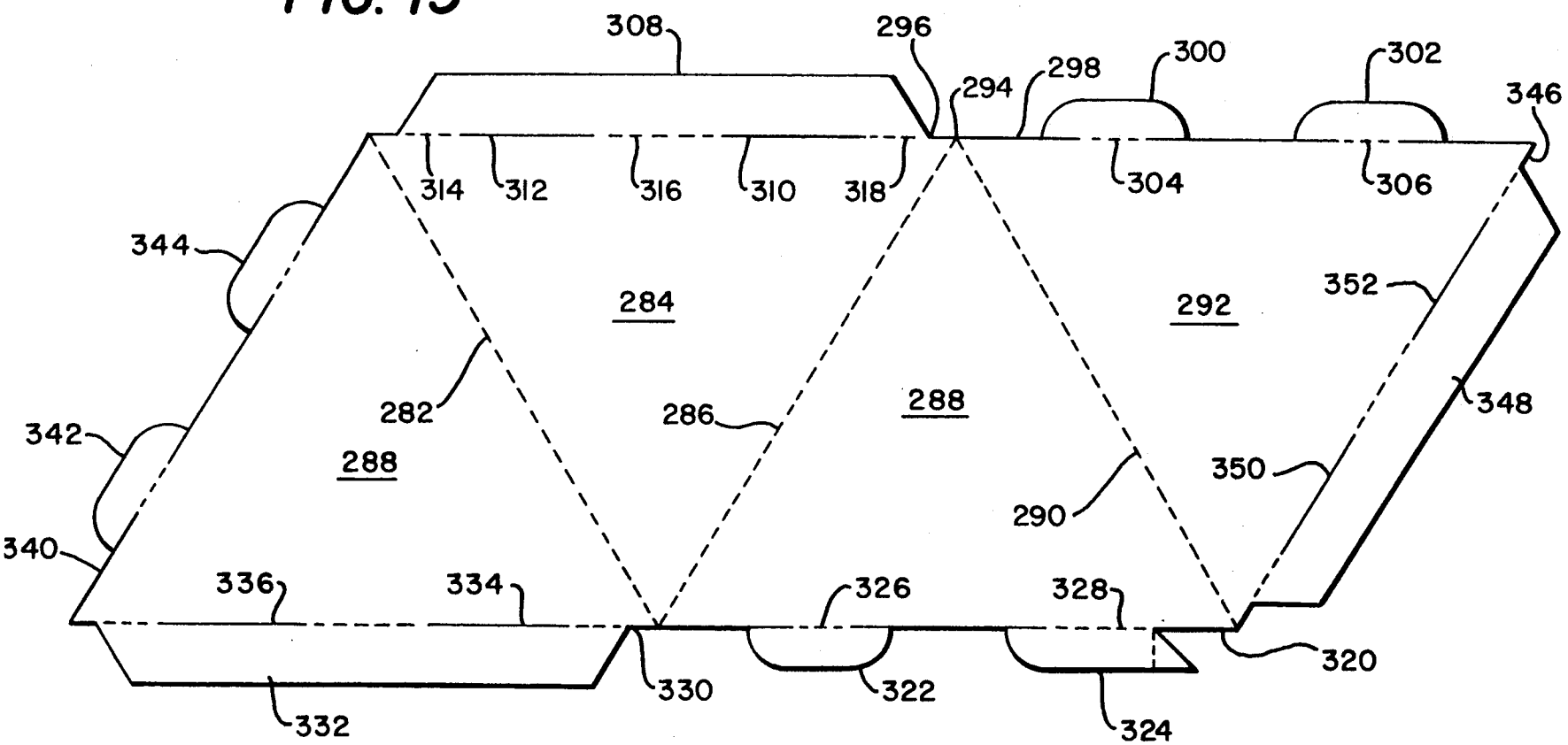
FIG. 15 is a schematic plan view of a flat blank for construction of a tetrahedron demonstrating the use of tab and slotted flaps having varying degrees of holding power and also demonstrating the unique code system for indicating connectable tabs and flaps and the order of connection according to the present invention.

In addition to a single tab and corresponding single slot in a flap for each free edge as discussed above, some large structures can beneficially employ multiple tabs for insertion into multiple slots. For example, in the flat sheet or blank for the construction of a tetrahydron as shown in FIG. 15, the base panel 280 is hingably connected at score line 282 to an adjacent side panel 284 which is hingably connected at 286 to a second side panel 288 which in turn is hingably connected at 290 to a third side panel 292. Thus, the apex of the tetrahedron will be at the intersection of hinge score line 286 and hinge score line 290 (i.e., apex 294) which also lies at the juncture between the free edge 296 of panel 284 and the free edge 298 of panel 292. Along free edge 298 are formed two tabs 300 and 302, which according to the terminology used herein are non-locking tabs. Tab 300 is hingably connected at score line 304 and tab 302 is hingably connected at score line 306 both colinearly disposed along free edge 298. Formed on free edge 296 is flap 308 having two slots 310 and 312 formed colinear with free edge 296 and also colinear with hingable connections 314, 316, and 318. Thus, to form the apex of the tetrahedron shape, tabs 300 and 302 are inserted into slots 310 and 312, respectively, thereby forming a crisp, non-interrupted edge to the tetrahedron where free edges 296 and 298 are held in an abutting relationship.

The use of two tabs and two slots is beneficial to maintain the crispness and non-buckling along the length of free edges 296 and 298 which in the case of a tetrahedron in which only four sides and therefore a limited volume results, the length of each edge can be substantial so that a single tab and a single slotted flap might result in some discontinuity or buckling of the connected edge.

On the opposite side of the blank at the free edge 320 of panel 288 two tabs 322 and 324 are formed hingably connected to panel 288 at 326 and 328, respectively. Also, along free edge 330 of base panel 280, a corresponding flap 332 is formed with slots 334 and 336 for the engagement of tabs 322 and 324, respectively. It will be noted that tab 322 is a non-locking tab for engagement into the non-locking slot 334. Tab 324 is preferably constructed according to the inventive hard locking tab design and slot 336 is correspondingly sized for receiving the hard locking tab.

Along the other free edge 340 of base panel 280, two non-locking tabs 342 and 344 are formed and on the second free edge 346 of the third panel 292 a flap 348 is formed having slots 350 and 352 formed colinear with free edge 346. Tabs 342 and 344 are hingably connected according to the invention as is flap 348 hingably connected along free edge 346. This construction, and in particular with tab 324 being a hard locking tab, permits the tetrahedral solid shape to be rigidly held together. There is substantial holding strength at hard locking tab 324 which is inserted into slot 336 so that the tetrahedral shape will not easily come completely apart. However, because tabs 300, 302, 342, and 344 are all non-locking tabs, the tetrahedral shaped carton can be opened and closed for easy access to and subsequent containment of the contents of a carton or package.

In the preferred embodiment the order of assembly is for tabs 300 and 302 to be interconnected with slots 310 and 312 first. This starting point is uniquely designated with a distinctive matching color or a distinctive design which is different from the color or design imprinted on the face panels and on other tabs and flaps. This distinctive color immediately draws the user's attention to the starting point. Also, to confirm the order of assembly the number "1" is printed on each of tabs 300, 302, and flap 308. Advantageously to further avoid confusion as to the appropriate reading of the numeral "1", the word "one" is also imprinted on each tab 300 and 302 and on the flap 308.

It has been found that the next preferred step of assembly is to interconnect 322 and 324 with slots 336 and 334 of tab 332. In this case a corresponding color or design is used on these next tabs and flaps to be assembled, which color or design is preferrably distinct from the printed panels as well as from the color and/or design of the initial tabs and flaps but which is preferably not quite as eye catching or distinctive as the first to be assembled tabs and flaps. For example, a distinctive color, red or black, may be used on the tabs 300 and 302 and flap 308 while a line of stars design may be used on the second to be assembled tabs 322 and 324 and flap 332. Again, to confirm the order of assembly, the number "2" is imprinted on the second to be assembled tabs and flaps Further, in the preferred embodiment, to reduce confusion as to the appropriate reading of the number "2" (which with some type face or print style might be confused as a number 7 or which might be confused with the number 5 by certain individuals with visual defects such as dyslexia), the word "two" is also printed. Upon completion of the assembly of the first and second group of tabs and flaps it will be clear to most users that tabs 342 and 344 are to be interconnected with the slotted flap 348 such that it is not necessary to provide those tabs and flaps with a highly distinctive eye catching color or design; but, rather, it is advantageous to leave those tabs non-distinct except to confirm the order of assembly with the numeral "3" and in the preferred embodiment also the word "three".

Figure 16:
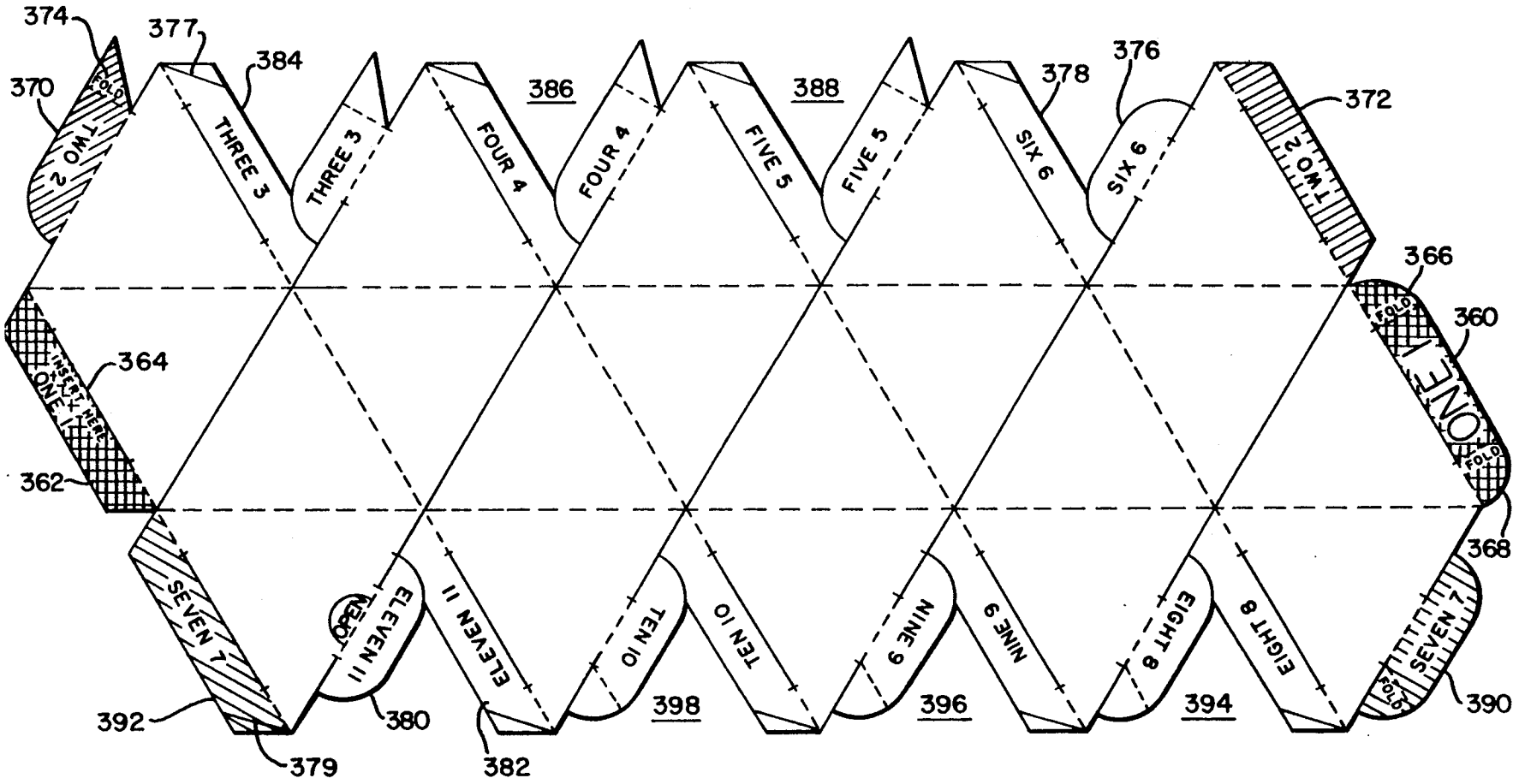
FIG. 16 is a plan view of a blank for the construction of a icosahedron demonstrating both varying degree holding power types of tab and flaps as well as the code system for indicating corresponding tab and flaps and the order of assembly.

Other advantages of Applicant's inventive system as shown in FIG. 16 result from various degrees of holding power tabs and flaps in combination with the inventive code for assisting the ordinary individual in constructing a complex shape. FIG. 16 is a plan view of a bank according to the present invention for the construction of a solid icosahedron which is a structure formed with twenty (20) equilateral triangular polygon face panels It will be noted that assembly is preferably started by interconnecting opposed forced tab 360 with slotted flap 362 which have according to the preferred embodiment been designated with the distinctive dark color and also the numeral "1" as well as the word "one". Instructions 364 reading "insert here" can also be included to assist the user. Likewise, instructions 366 and 368 on tab 360 reading "fold" can further be of assistance to the user to understand instantaneously the nature and use of the forced tab 360.

Next, tab 370 which has holding powers slightly less than the forced tab 360 such as a hard locking tab as indicated is to be assembled and interconnected with slotted flap 372. Again, a distinctive design as well as the order indicating numeral "2" and preferably a)so the word "two" are imprinted on both the tab 370 and flap 372. Also, instructions 374 such as "fold" can be advantageously printed to assist the user by providing a quick functional understanding of the use of a hard locking tab.

The order of assembly progresses with numbered tabs and flaps in order of their assembly as shown therefore providing numbering from one through eleven. Preferably after the initial opposed tab 360 and flap 362 are connected, each of the two sides of the blank is connected sequentially with the first sequence held harder than the last. Thus, the second tab 370 and flap 372 and the third 384, fourth 386, and fifth 388 tab and flap assemblies are hard locking and the seventh tab 390 and flap 392 and the eighth 394, ninth 396, and tenth 398 are angle locking tab and flap assemblies. Again, because the seventh tab 390 is at an opposed end of the blank from the seventh flap 392, they are both provided with a distinctive color or design, and preferably the numeral "7" and the word "seven". The seventh, eighth, ninth, and tenth flaps to be assembled, i.e., tab and flap 390 and 392 and tab and flap assemblies 394, 396 and 398 are all provided with angle locking tab and flap assemblies. As the icosahedron figure nears completion of assembly it becomes increasingly difficult to insert the tabs and flaps such that the more easily insertable angle locking tab and flaps are used near the end of the sequence of assembly. The easiest to assemble and therefore easiest to disassemble configuration of tabs and flaps 376 and 378 and tab and flap 380 and 382 are strategically located at the sixth and eleventh tab and flaps of each series of connections second through sixth and seventh through eleventh.

FIG. 16 further shows alternative trim lines 377 on the third, fourth, fifth and sixth flaps on one side of the blank and trim lines 379 on the eighth, ninth, tenth, and eleventh flaps on the other side of the blank. Trimming the exterior corner of the flaps will allow clearance for better fitting flaps at the apex on either side of the assembled icosahedron.

Figure 17:
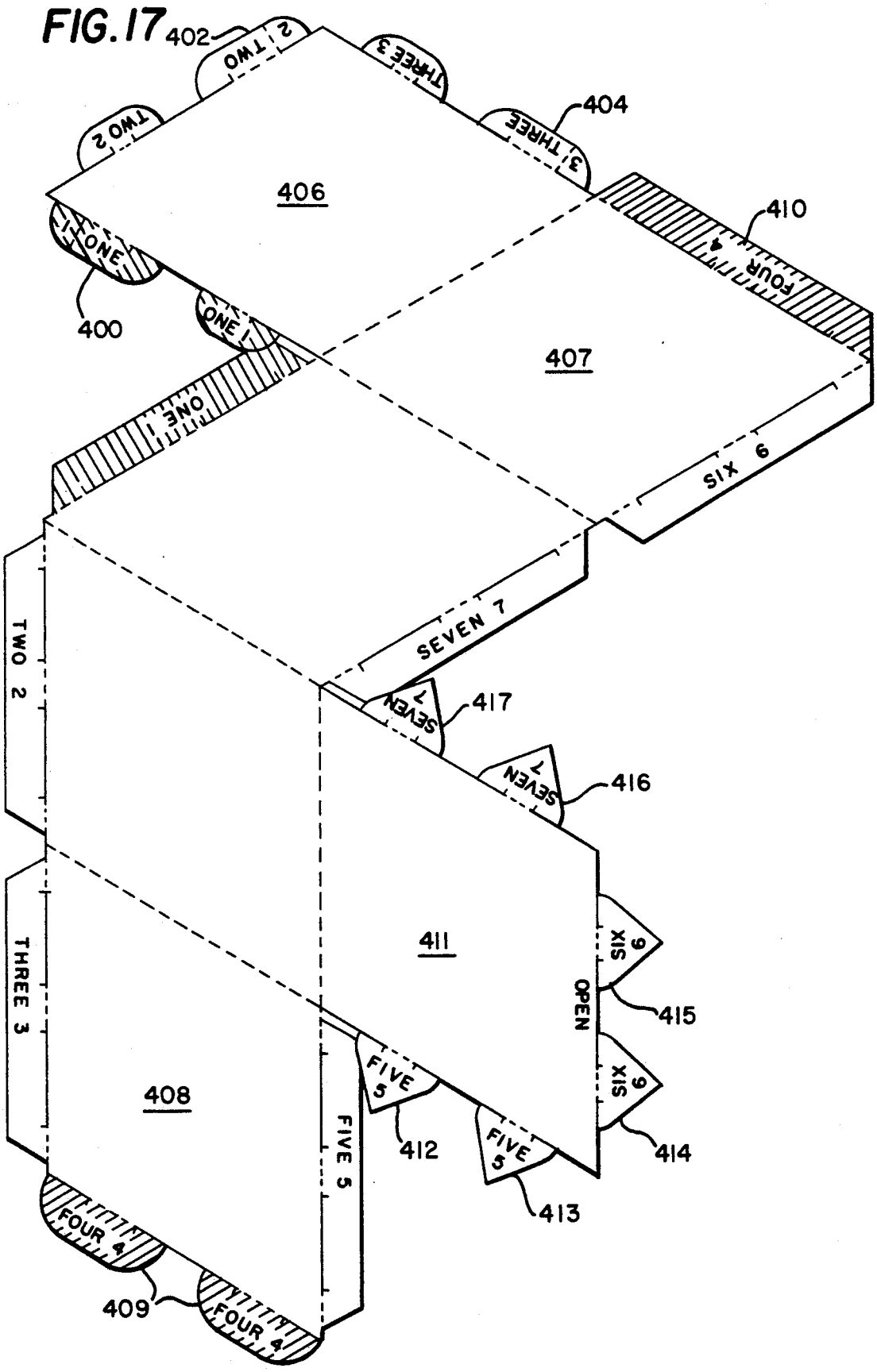
FIG. 17 is a plan view of a blank for the construction of a rhomboid according to the present invention.

In FIG. 17, a blank for the construction of a rhomboid is depicted in which hard locking tabs 400, 402, and 404 are provided paired with non-locking tabs 401, 403, and 405, respectively, hingably connected to each free edge of base quadrilateral panel 406. The free edge connection between side panels 407 and 408 is accomplished with a pair of non-locking tabs 409 and slotted flap 410. The top quadrilateral panel 411 is provided with spade tipped pairs of non-locking tabs 412 and 413, 414 and 415, and 416 and 417 which will be the last to assemble tab and slot devices. Thus, the base and sides are conveniently and rigidly affixed using hard locking tabs at the base panel 406. The top panel 411 is easily openable and reclosable using the non-locking spade tipped tabs.

Figure 18:
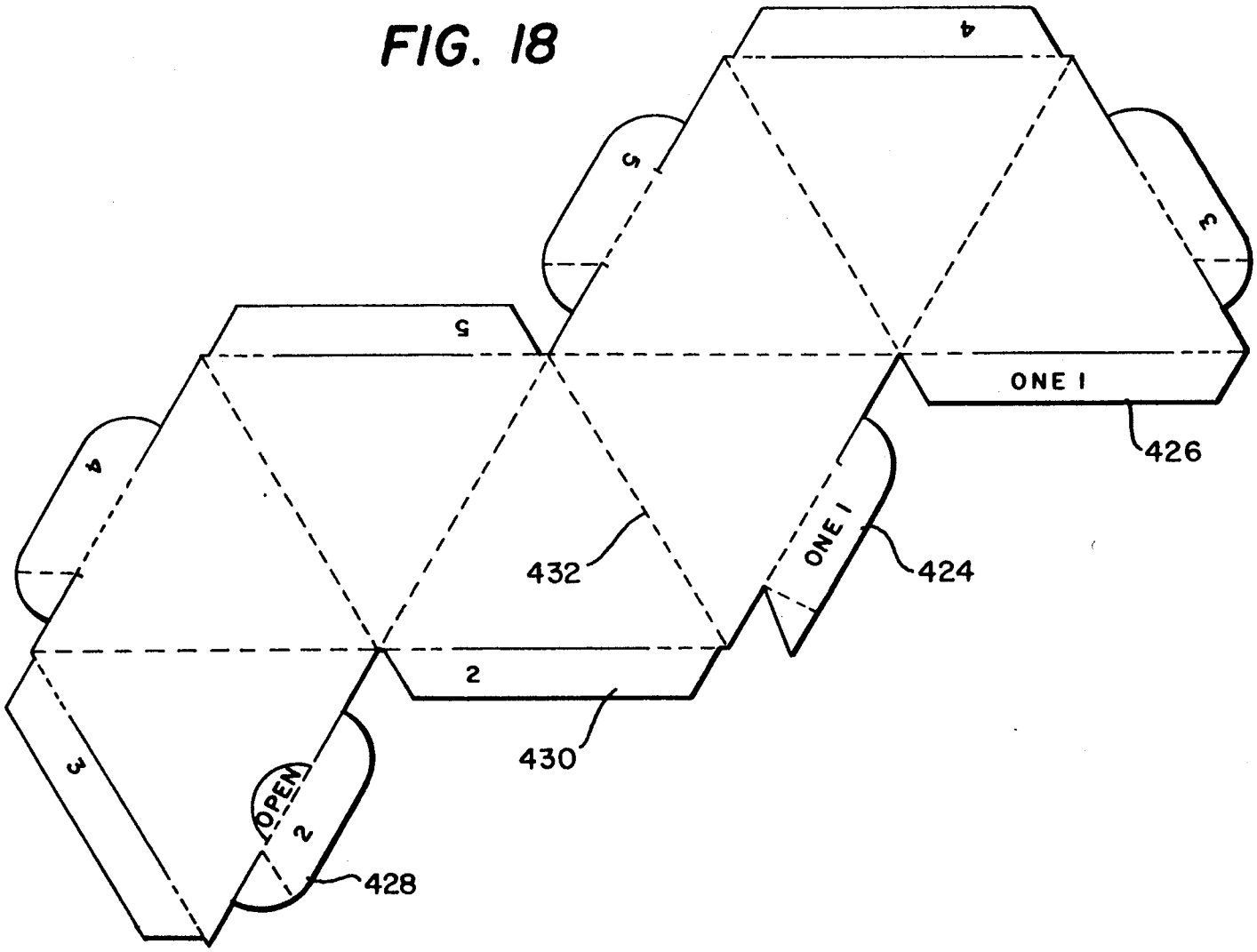
FIG. 18 is an octahedron according to the present invention.

Another mathematically significant polyhedron is shown in FIG. 18 which is a blank for the construction of an octohedron. In this figure the base pyramid is initially formed using the hard locking tab 424 which is also imprinted with the number "1" and the corresponding slotted flap 426 which also has a corresponding number "1" indicated the starting point for the construction. Having formed a strong base pyramid then angle locking tab 428 designated with the sequence number "2" is next assembled to the corresponding slotted flap 430 also correspondingly designated with the sequence indicator number "2" according to the invention. This forms two opposed four sided pyramids which upon folding along hinge line 432 provide alignment between the third, fourth, and fifth tab and flaps to be assembled. Each of the third, fourth, and fifth flaps are provided with angle locking configurations to provide sufficient strength in this eight sided figure to hold materials. It is noted that an instruction 434 such as "open" may be imprinted adjacent tab 428 to easily and conveniently signify to the user the preferred place to be begin disassembly and the preferred place to provide access to the interior of the carton to conviently view or extract its content.

Figure 19:
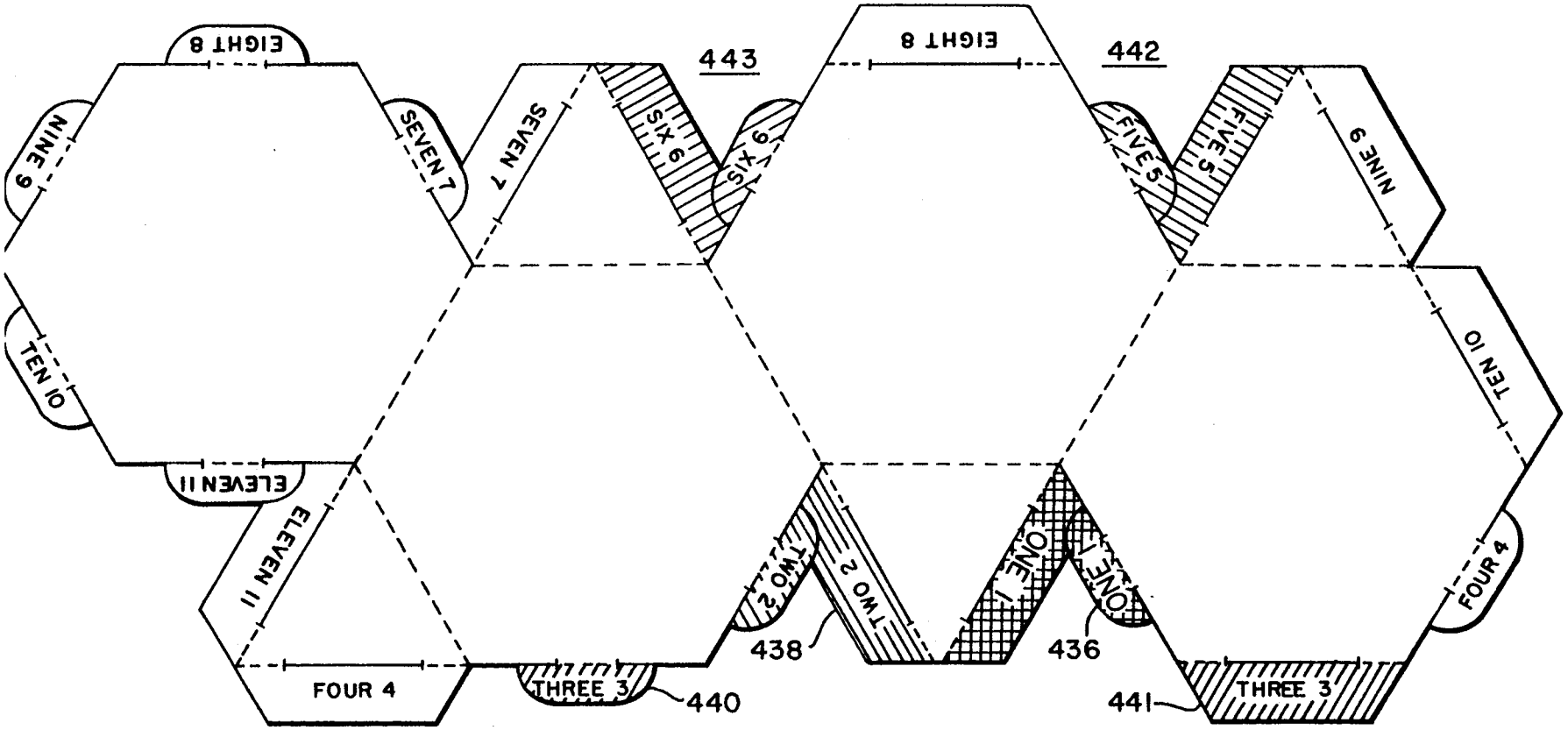
FIG. 19 is a plan view of a blank for the construction of a truncated tetrahedron with coded tab and flaps according to the present invention.

FIG. 19 is a schematic depiction of a blank for the construction of a truncated tetrahedron. In this unique figure it has been found that even without varying degree holding power of the tabs and flaps it is extremely advantageous because of the complexity and unfamiliarity by most people with the resulting shape of a truncated tetrahedron to sequentially number the order in which assembly is to proceed and also to use distinctive color coding for the first steps on each side of the blank. Thus, preferably the most distinctive color is used for tab and flap assembly 436 which is also designated with the order indicating code number "1" and also a next most distinctive color or design being used for tab and flap 438 which is to be designated with the order indicating code number "2" and tab 440 and flap 441 with a lesser distinct color or design and the order designating numeral "3". Upon completion of assembly of tab 440 and 442 the next tab and flaps to be assembled will be in a similar location such that the numeral designation "4" is all that is required and a non-distinct or blank color can be used thereby proving added distinctiveness to those tabs and flaps which are color coded. On the opposite side of the figure, tab and flap assemblies 442 (the fifth tab and flaps to be assembled) and 443 (the sixth tab and flaps to be assembled) are also distinctively color coded or distinctively designed with the order indicating numerals five and six, respectively. Again, as the assembly progresses each of the remaining tabs and flaps will be in an adjacent location to one another such that an order confirming code numbers 7, 8, 9, and 10 are imprinted on corresponding tabs and flaps.

Figure 20:
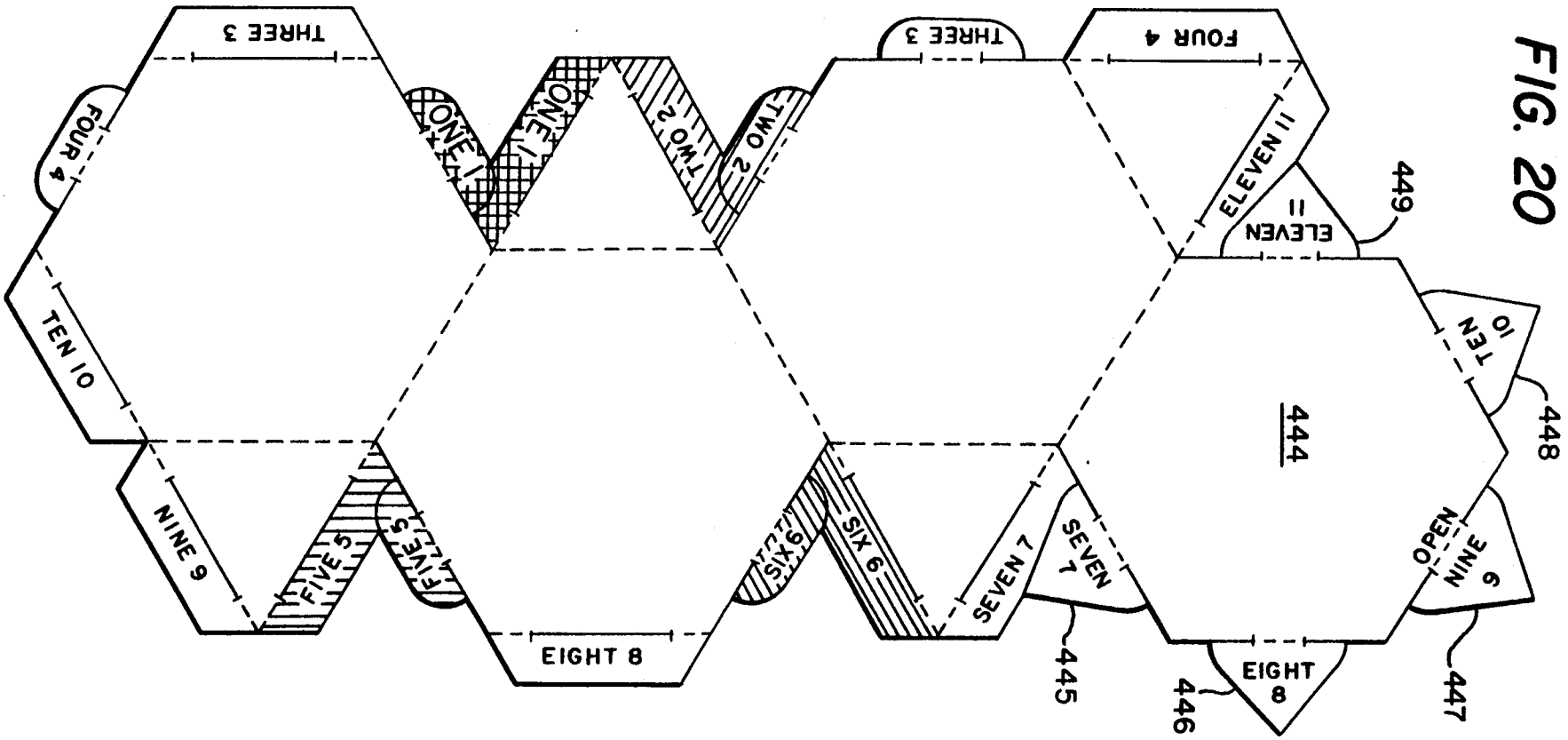
FIG. 20 is a plan view of an alternative blank for the construction of a truncated tetrahedron according to the present invention.

An alternative embodiment of a blank for the construction of a truncated tetrahedron is shown in FIG. 20. This blank advantageously employs spade tipped non-locking tabs 445, 446, 447, 448, and 449 for the easily closeable and openable top panel 444.

Figure 21:
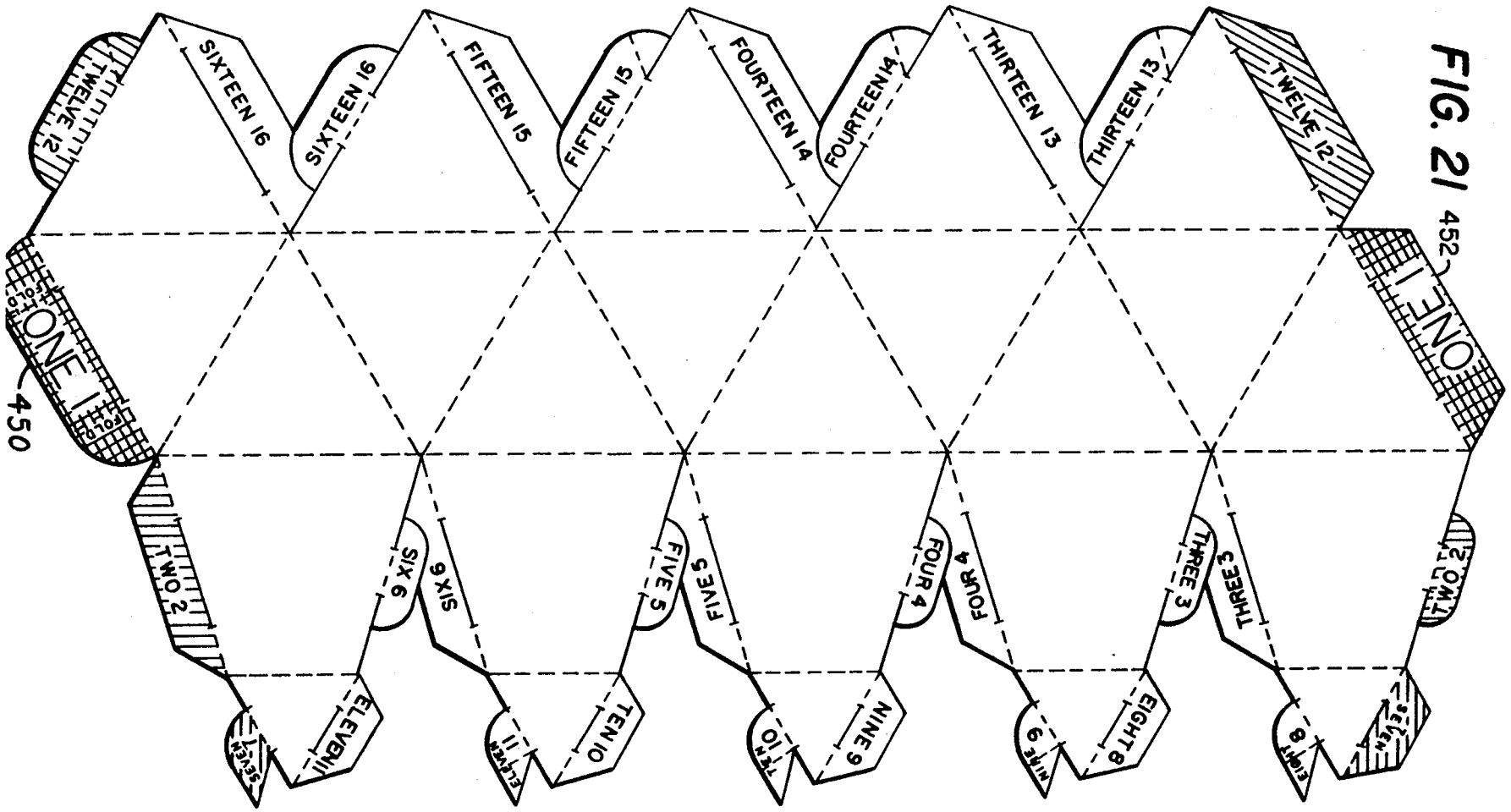
FIG. 21 is a plan view of a blank for the construction of a non-standard solid shape hereby designated Egg I showing tab and flaps of varying degrees of holding power and the unique code system according to the present invention.

With reference to FIG. 21, a non-standard and non-mathematically and non-academically significant yet unique and esthetically pleasing figure or at least the blank for the construction of such a figure is depicted. This figure is somewhat descriptively termed by the inventor as "Egg I". The resulting solid figure has twenty-five polygon-shaped faces, fifteen of which are equilateral triangles all of the same size, five of which faces are equilateral triangles of a smaller size than the fifteen equilateral triangle shaped faces and five of which are trapezoid shaped face panels. Once again, the opposed beginning tab 450 and beginning flap 452 form a forced locking tab and flap assembly and are provided with the distinctive color code as well as the number "1" both numerically and as a word. It is further noted for added distinctiveness in this complex figure the number "1" is provided in enlarged typeface both for the word and for the number to further draw the user's attention instantaneously to the beginning position. Also, each of the interconnecting tabs and flaps on opposite ends of the blank are provided not only with the numeric designation but also with progressively reduced distinctiveness of the colors and designs. Thus, the second, seventh, and twelvth tabs and flaps to be assembled are color coded as well as numeral coded. On extremely small tabs and flaps, such as the seventh, space limitations may indicate that only a numeral "7" rather than also the word "seven" may be imprinted thereon.

The various degrees of holding power will be understood from reference to the schematic drawing FIG. 21 in which the second, third, fourth, fifth, and sixth tab and flap assemblies to be connected are each non-locking tabs and flaps. The seventh, eighth, ninth, tenth, and eleventh tab and flap assemblies are hard locking and the twelvth, thirteenth, fourteenth, and fifteenth are angle locking with the final or sixteenth tab and flap assembly again being a non-locking tab and flap corresponding to the non-locking sixth tab and flap. It being noted that even where there is provided sufficient strength by other angle locking tabs and flaps, the ease of assembly of the final tab and flap, i.e., the sixteenth tab and flap in this case, in the series of twelvth, thirteenth, fourteenth, fifteenth, and sixteenth makes it advantageous to have the ease of assembly of the non-locking tab and flap.

Figure 22:
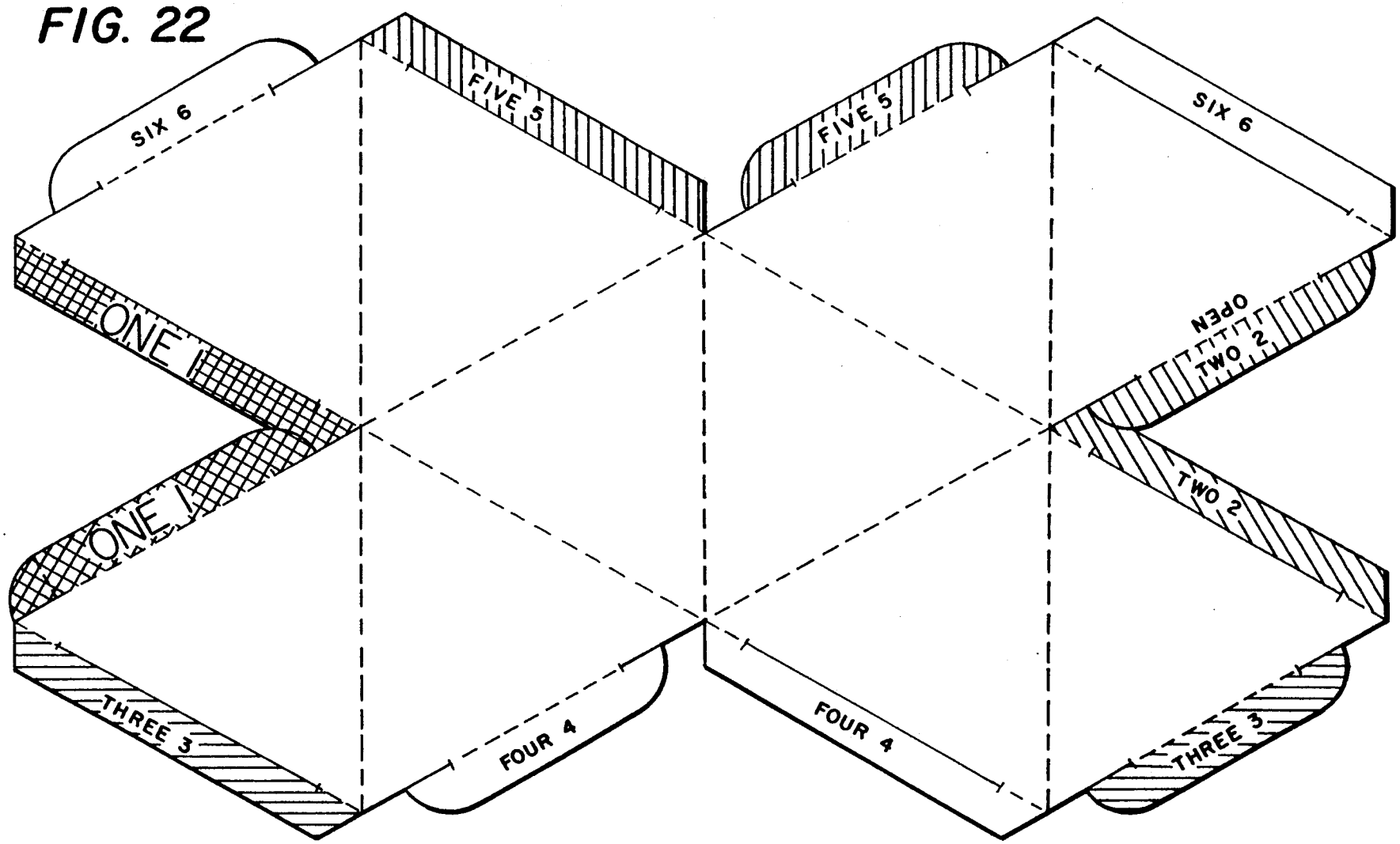
FIG. 22 is a plan view of a blank for the construction of a decadeltahedron according to the present invention.

FIG. 22 depicts a blank for the construction of a decadeltrahedron which has ten equilateral triangular shaped faces.

Figure 23:
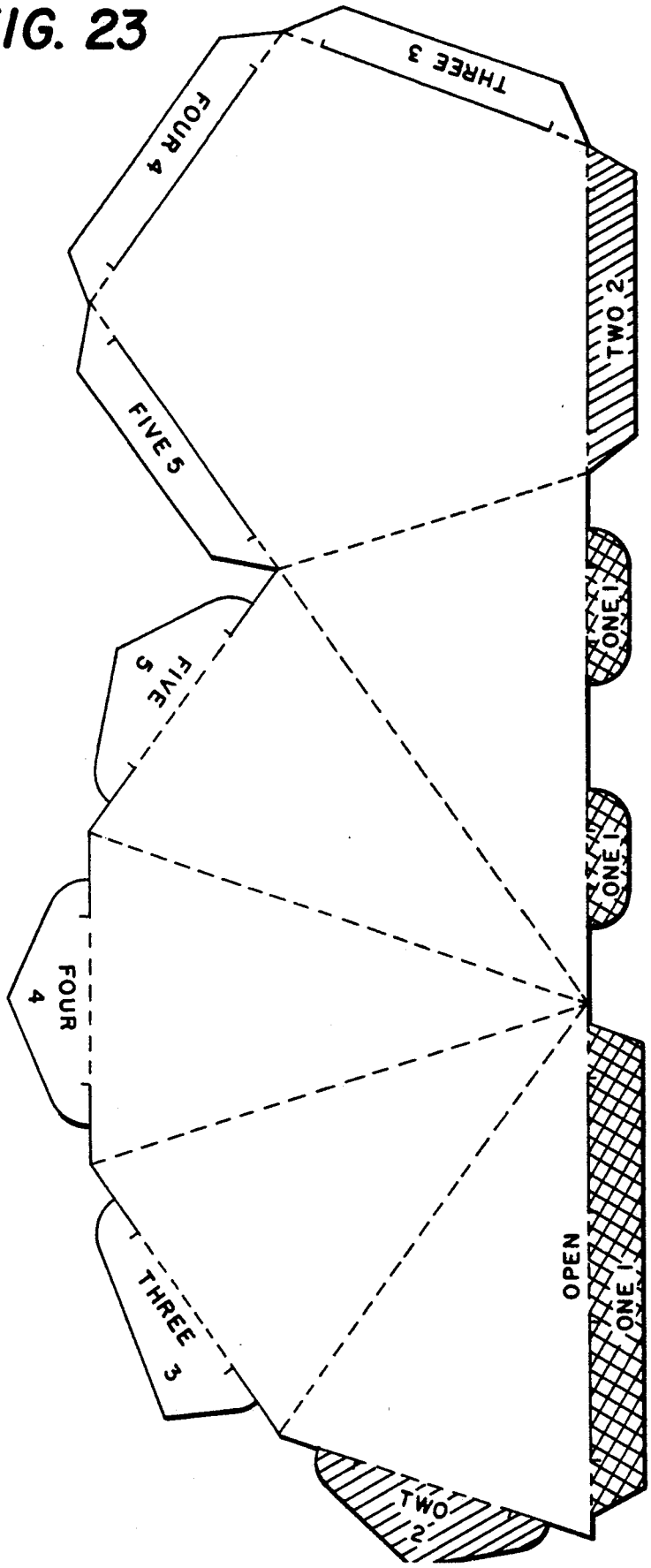
FIG. 23 is a schematic plan view of a blank for the construction of a pentagonal pyramid according to the present invention.

FIG. 23 is a schematic depiction of a blank for the construction of a pentagonal pyramid having a pentagon shaped base and five triangular shaped sides.

Figure 24:
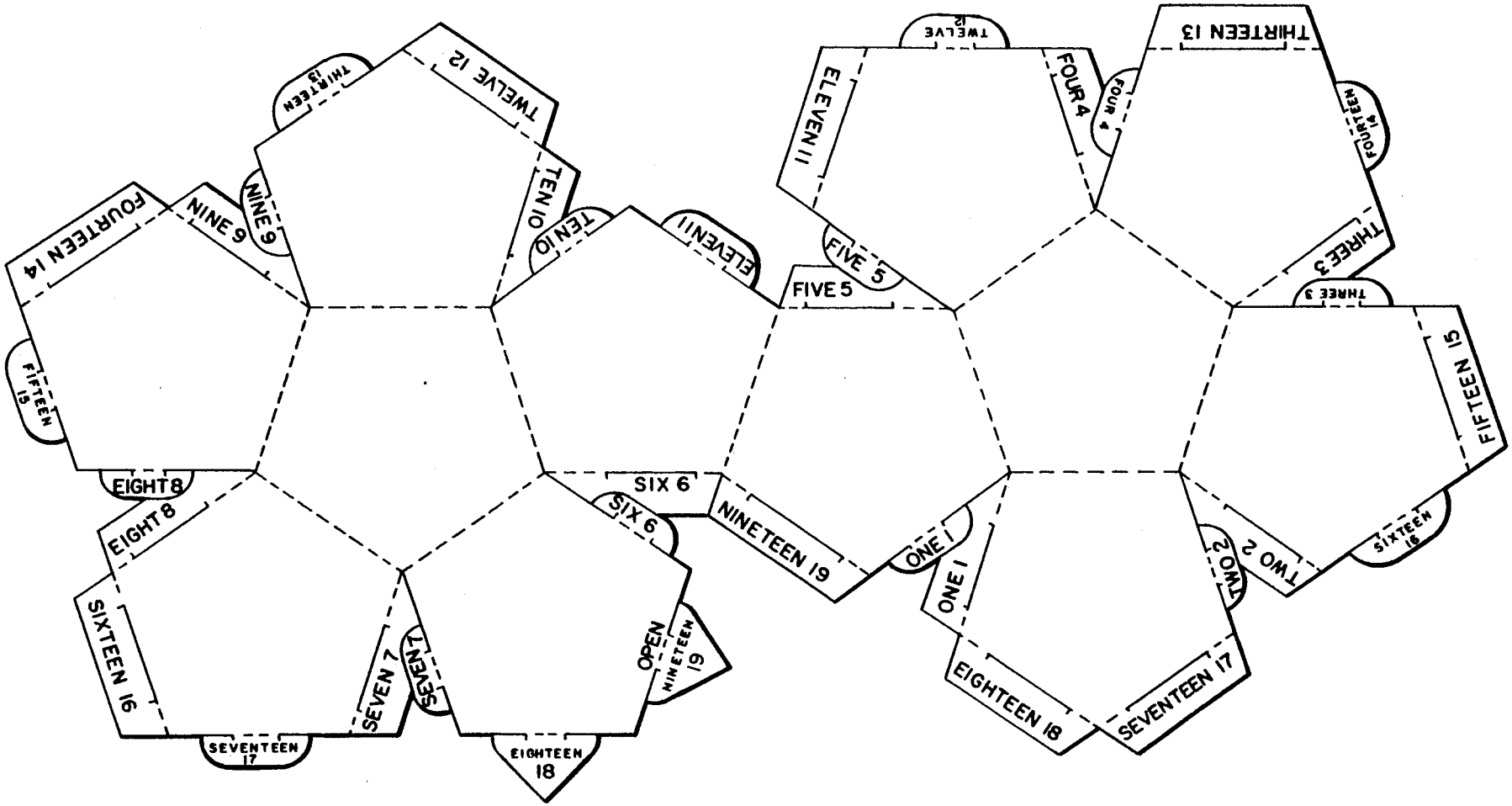
FIG. 24 is a plan view of a blank for the construction of a dodecahedron according to the present invention.

FIG. 24 shows a blank for the construction of a dodecahedron which has twelve faces which are pentagon shapes each of identical size.

Figure 25:
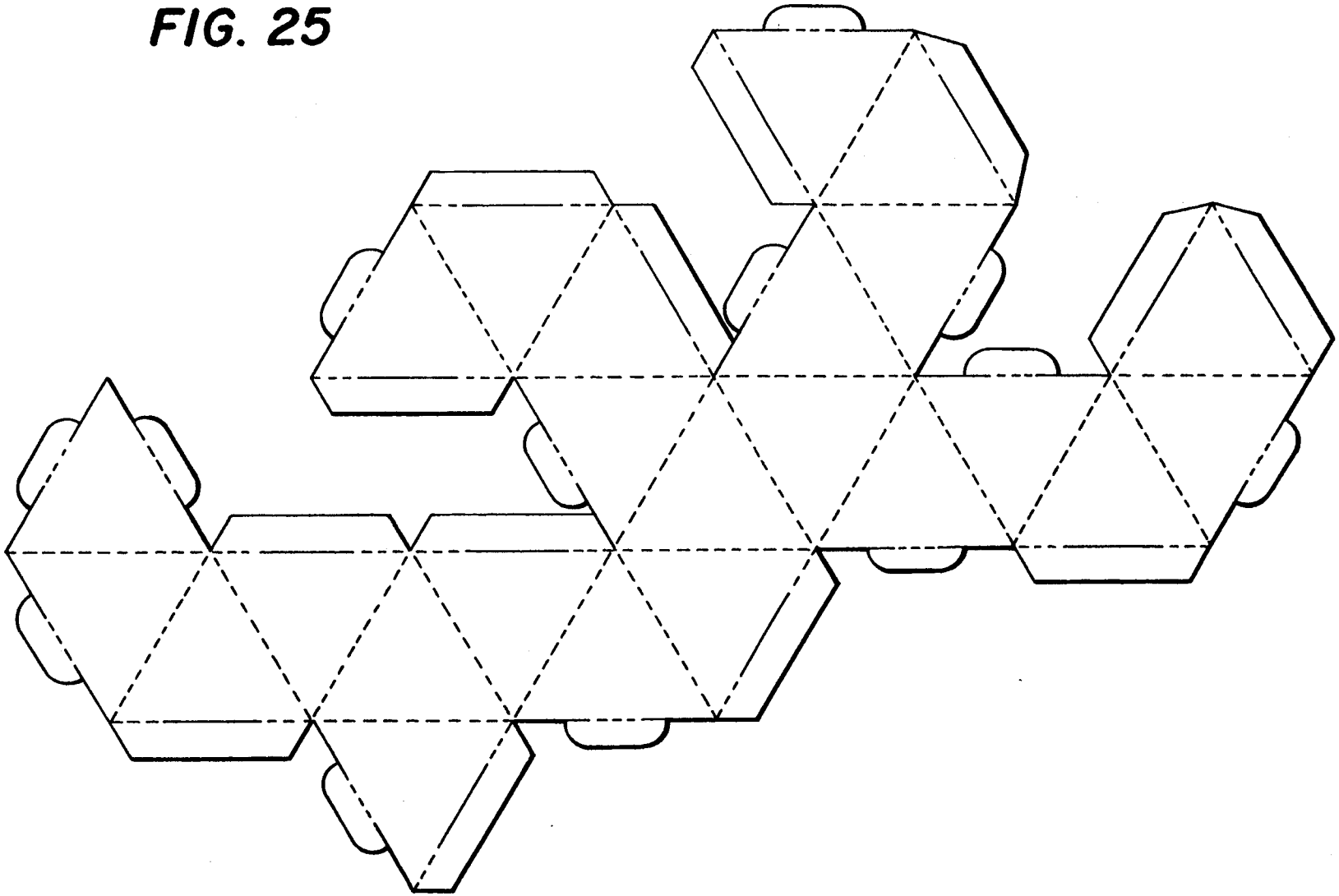
FIG. 25 is a plan view of a blank for the construction of a cube with square pyramids on each face according to the present invention.

FIG. 25 depicts a blank for the construction of a cube with square pyramids on each face which is constructed with twenty-four equilateral triangular shaped face panels.

Figure 26:
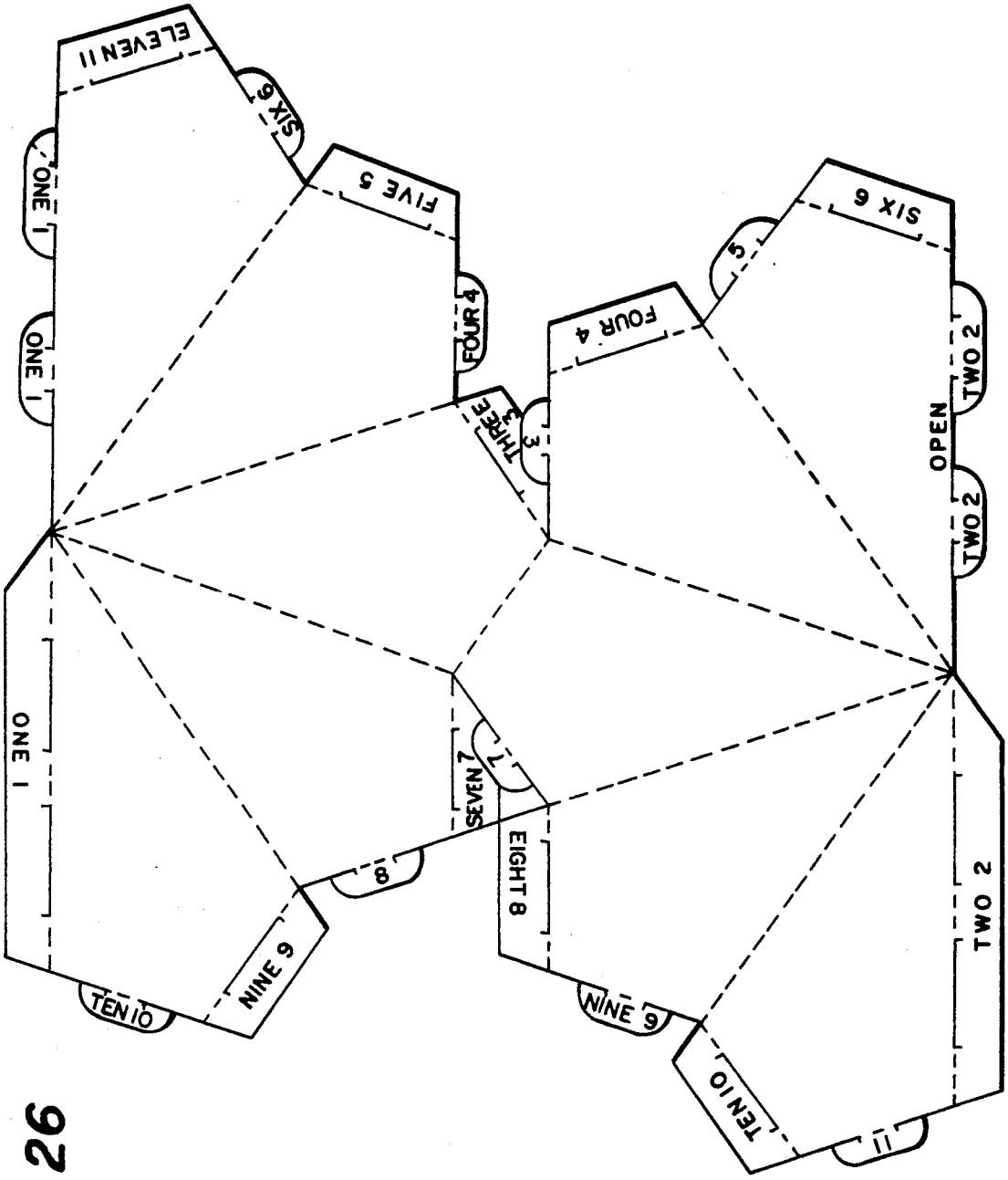
FIG. 26 is a plan view of a blank for the construction of a trapezohedron according to the present invention.

FIG. 26 depicts a plan view of a blank for the construction of a trapezohedron which has ten identical quadrilateral faces.

Figure 27:
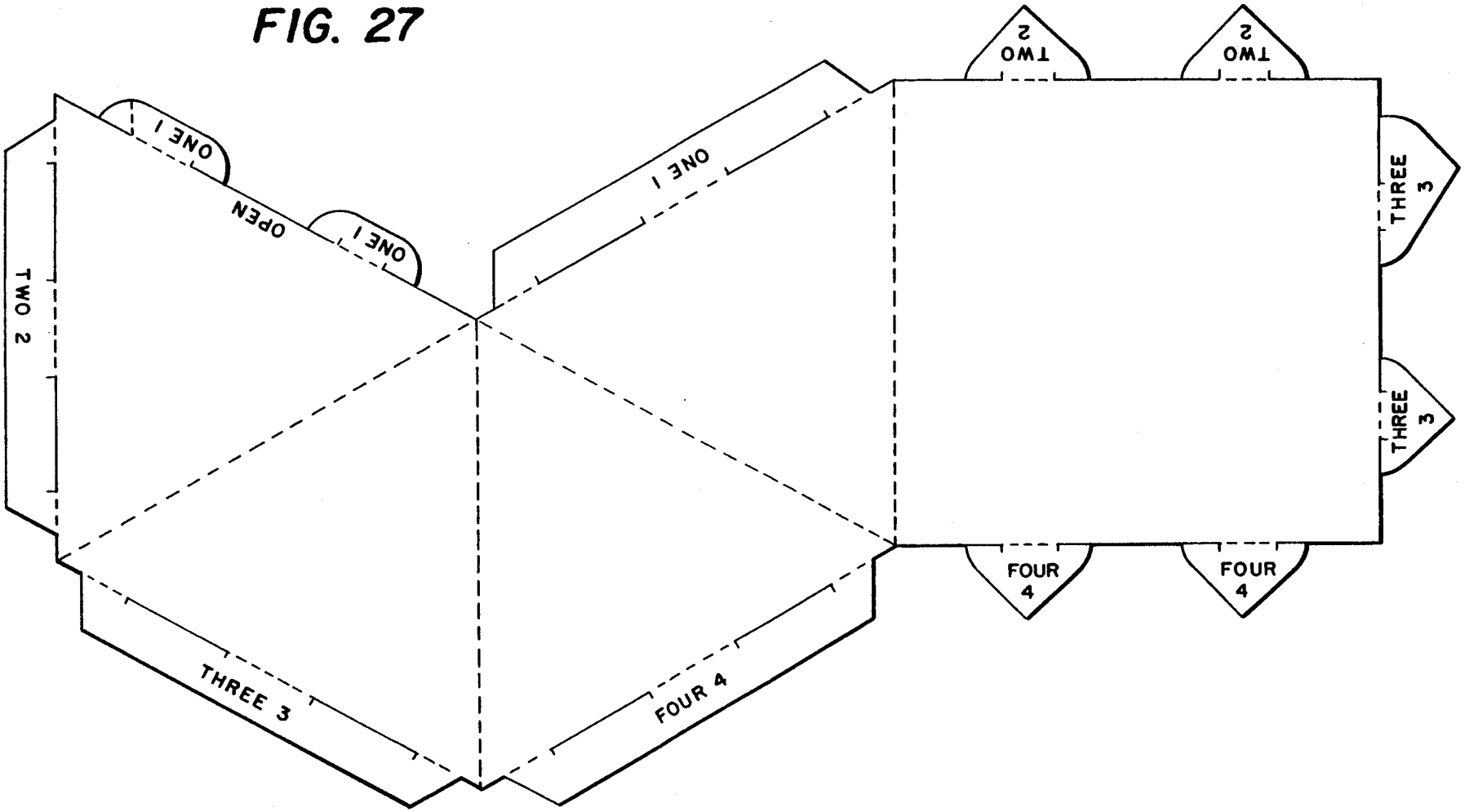
FIG. 27 is a plan view of a blank for the construction of a square pyramid according to the present invention.

FIG. 27 depicts a square pyramid having a square shaped base with four triangular shaped faces to form the pyramid.

Figure 28:
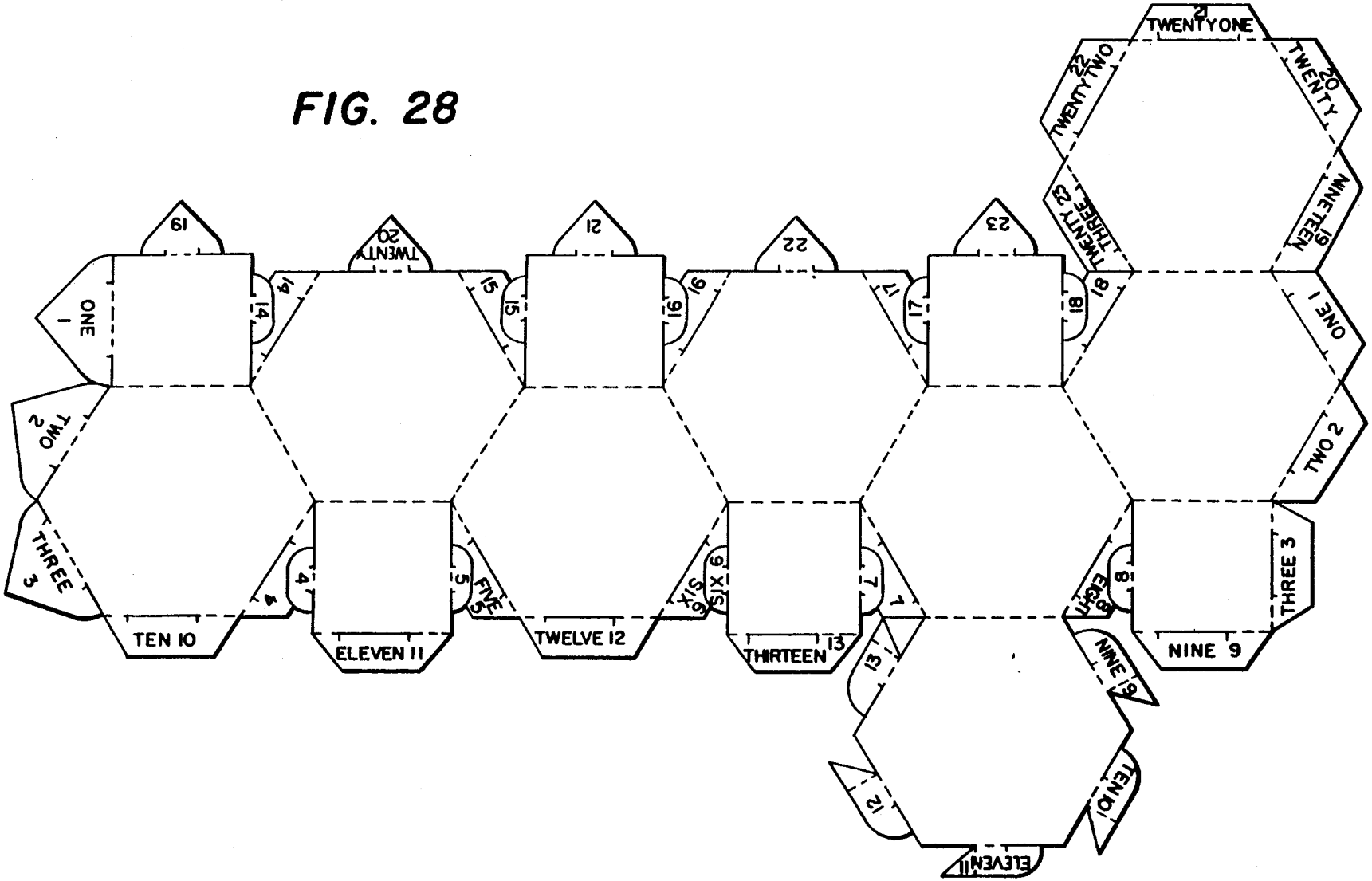
FIG. 28 is a plan view of a blank for the construction of a truncated octahedron according to the present invention.

FIG. 28 depicts a truncated octahedron in which there are eight hexagon faces and six square faces.

Figure 29:
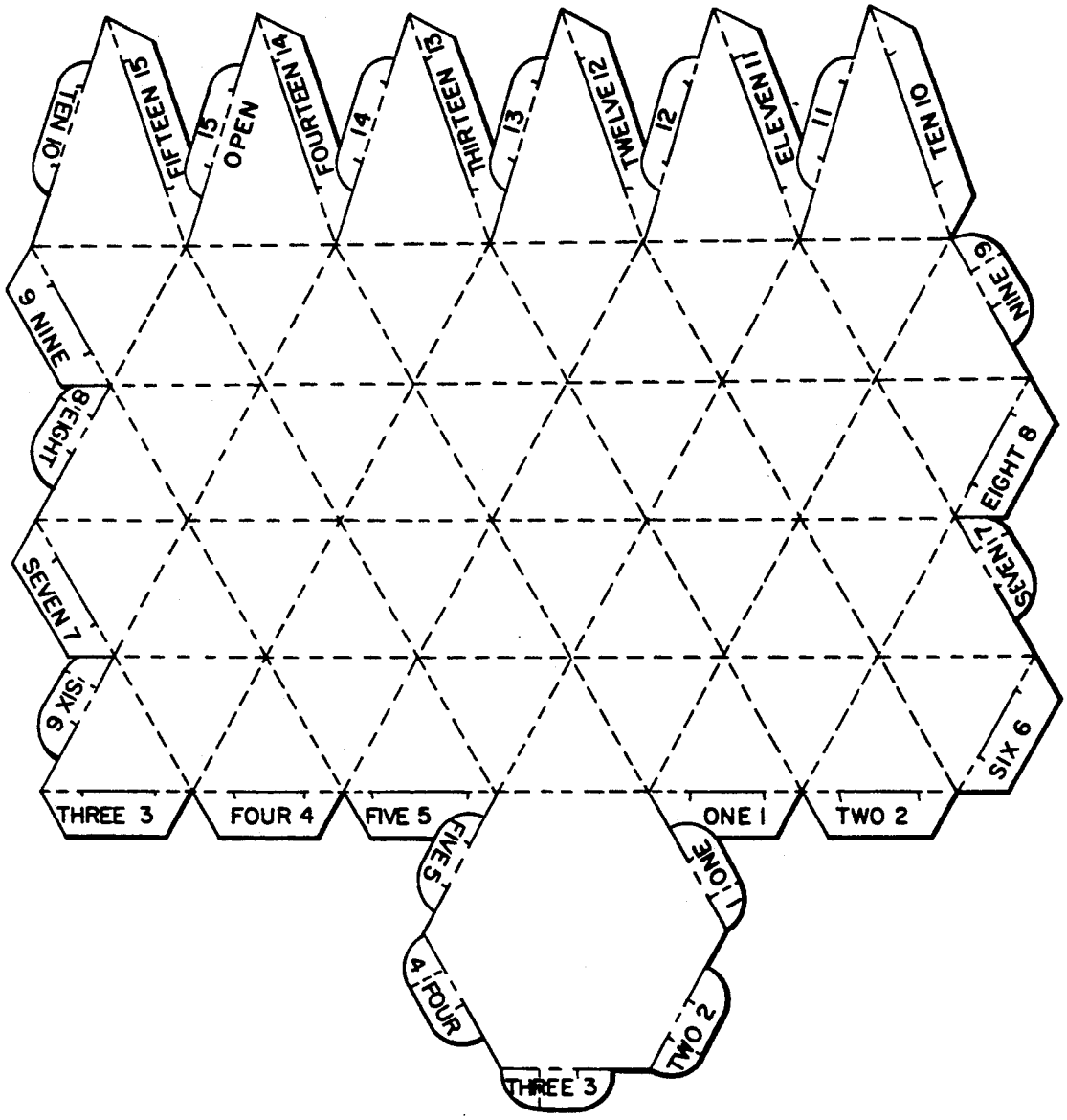
FIG. 29 is a plan view of a blank for the construction of a hexagonal tower box according to the present invention.

FIG. 29 is a plan view of a blank for the construction of a pentagonal tower box according to the present invention.

Figure 30:
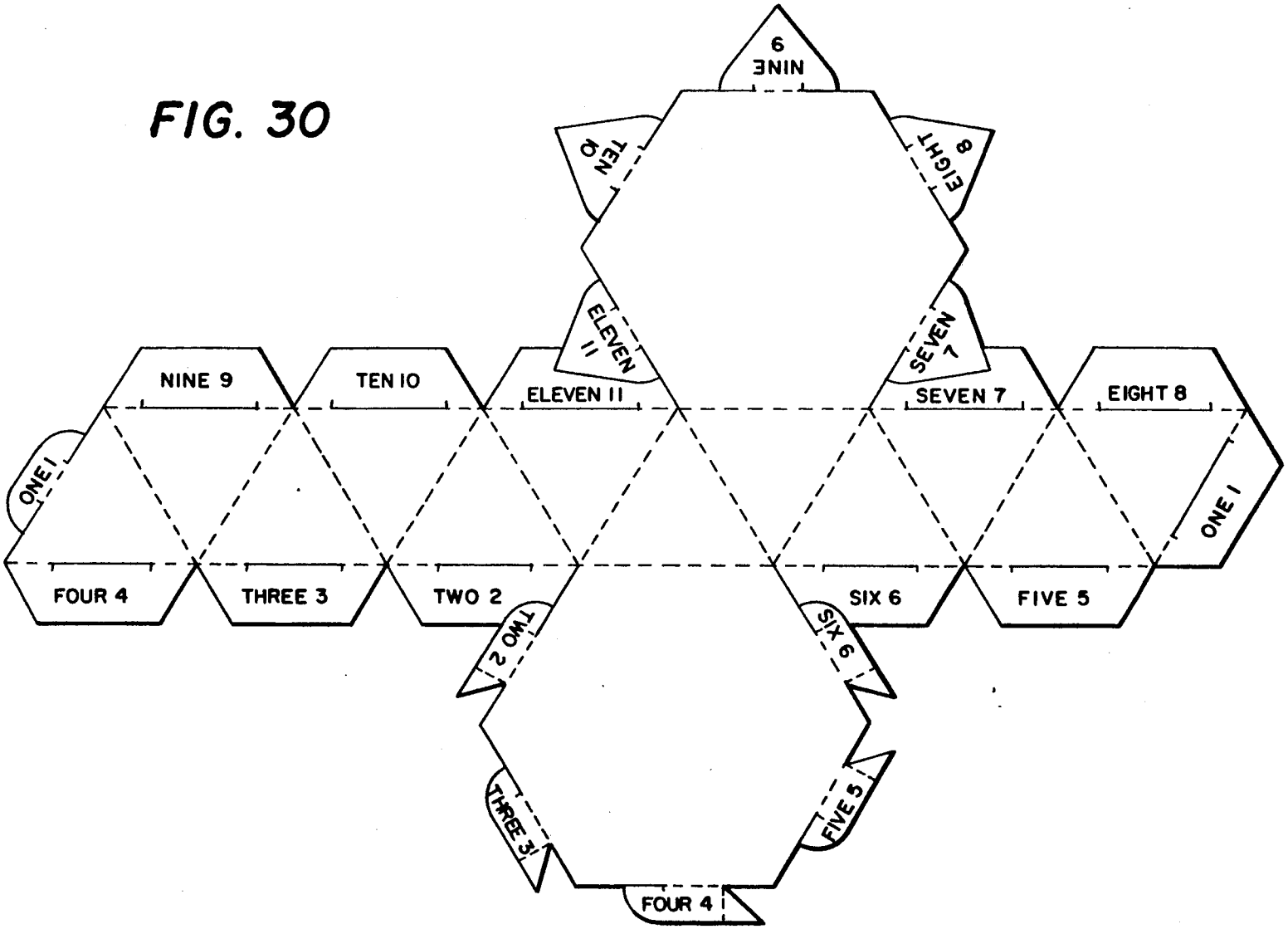
FIG. 30 is a plan view of a blank for the construction of a hexagonal anti-prism according to the present invention.

FIG. 30 is a plan view of a blank for the construction of a hexagonal anti-prism according to the present invention.

Thus, what has been disclosed is a system of varying degree holding power and varying ease of assembly tab and slotted flap devices for use in the construction of multi-sided packages and cartons. Both mathematically significant polyhedra as well as unique and mathematically nonsignificant solid shapes can be beneficially constructed with this system of tabs and slotted flaps. Further, what has been disclosed is a system and code for advantageously indicating to the user the beginning point for assembly of complex multi-sided solid shapes as well as indicating the preferred sequence for assembly and the corresponding tab and slotted flaps to be interconnected. This inventive system of tabs and slotted flaps and of assembly facilitating code provides unique and substantial advantages in the area of packages or cartons for holding other objects in a manner which can be both easily assembled and disassembled. Other benefits include easy partial opening for access to the content of the package or carton and easy reclosing.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A system for construction of a multi-sided solid shaped carton, package, or box comprising:

(a) a flat blank having multiple polygon shaped faces, each face hingably connected to at least one other face, and having free edges of said faces connectable to free edges of other faces to form said multi-sided carton;

(b) a first edge forming element for connecting a first pair of said free edges with a first degree of holding force, including a first tab hingably connected to one free edge of said first pair of free edges and a correspondingly constructed slotted flap hingably connected to another free edge of said first pair of free edges; and (c) a second edge forming element for connecting a second pair of said free edges with a second degree of holding force which is greater than said first degree of holding force, including a second tab hingably connected to one free edge of said second pair of free edges and a correspondingly constructed slotted flap hingably connected to another free edge of said second pair of free edges.

2. A system for construction of multi-sided solid shapes as in claim 1 wherein:

(a) said first tab and slotted flap edge forming element is selected from a group of types of tab and slotted flap edge forming elements including non-locking, angle locking and hard locking; and (b) said second tab and slotted flap is selected from a group of types of tab and slotted flaps including angle locking, hard locking and forced locking such that said second tab and slotted flap edge forming element has greater holding strength than said first tab and slotted flap edge forming element.

3. A system for construction of multi-sided solid shapes as in claim 1 wherein:

(a) said first tab and slotted flap edge forming element is selected from a group of types of tab and slotted flap edge forming elements including spade tipped non-locking, spade tipped angle locking and spade tipped hard locking; and (b) said second tab and slotted flap edge forming element is selected from a group of types of spade tipped angle locking, spade tipped hard locking, and spade tipped forced locking such that said second tab and slotted flap edge forming element has greater holding strength than said first tab and slotted flap edge forming element.

4. A system for construction of multi-sided solid as in claim 1 wherein the solid shape is a tetrahedron.

5. A system for construction of multi-sided solid shapes as in claim 1 wherein the solid shape is an icosahedron.

6. A system for construction of multi-sided solid shapes as in claim 1 wherein the solid shape is a rhomboid.

7. A system for construction of multi-sided solid shapes as in claim 1 wherein the solid shape is an octahedron.

8. A system for construction of multi-sided solid shapes as in claim 1 wherein the solid shape is a truncated tetrahedron.

9. A system for construction of multi-sided solid shapes as in claim 1 wherein the solid shape is an Egg I.

10. A system for construction of multi-sided solid shapes as in claim 1 wherein the solid shape is a decadeltrahedron.

11. A system for construction of multi-sided solid shapes as in claim 1 wherein the solid shape is a pentagonal pyramid.

12. A system for construction of multi-sided solid shapes as in claim 1 wherein the solid shape is a dodecahedron.

13. A system for construction of multi-sided solid shapes as in claim 1 wherein the solid shape is a cube with square pyramids on each face.

14. A system for construction of multi-sided solid shapes as in claim 1 wherein the solid shape is a trapezohedron.

15. A system for construction of multi-sided solid shapes as in claim 1 wherein the solid shape is a square pyramid.

16. A system for construction of multi-sided solid shapes as in claim 1 wherein the solid shape is a truncated octahedron.

17. A system for construction of multi-sided solid shapes as in claim 1 wherein the solid shape is a Hexagonal Tower Box.

18. A system for construction of multi-sided solid shapes as in claim 1 wherein the solid shape is a Hexagonal Anti-prism.

19. A construction for a multi-sided solid-shaped carton, package, or box as in claim 1 further comprising symbol means for drawing attention to the preferred starting point of construction, for designating the appropriate correspondence between said tab and slotted flap edge forming elements, and for designating the preferred order of assembly.

20. A construction as in claim 19 wherein said symbol means comprises:

(a) distinctive corresponding color on at least one selected corresponding tab and slotted flap edge forming element to be assembled; and (b) sequential corresponding numbers on said corresponding tab slotted and flap edge forming elements to be assembled, which number are in sequence on said tab and slotted flap edge forming elements in order of the preferred assembly.

21. A construction as in claim 19 wherein said symbol means further comprises:

(a) distinctive corresponding design on at least one selected corresponding tab and slotted flap edge forming element to be assembled; and (b) sequential corresponding numbers on said corresponding tab and flap edge forming element to be assembled, which number sequence corresponds to the order of preferred assembly.

22. A construction as in claim 20 wherein said sequential numbers are printed both numerically and as a word.

23. A construction as in claim 21 wherein said sequential numbers are printed numerically and as a word.

24. A construction for a multi-sided solid shape as in claim 19 wherein said multi-sided solid shape is a tetrahedron.

25. A construction for a multi-sided solid shape as in claim 19 wherein said multi-sided solid shape is an icosahedron.

26. A construction for a multi-sided solid shape as in claim 19 wherein said multi-sided solid shape is a rhomboid.

27. A construction for a multi-sided solid shape as in claim 19 wherein said multi-sided solid shape is an octahedron.

28. A construction for a multi-sided solid shape as in claim 19 wherein said multi-sided solid shape is a tetrahedron.

29. A construction for a multi-sided solid shape as in claim 19 wherein said multi-sided solid shape is an Egg I.

30. A construction for a multi-sided solid shape as in claim 19 wherein said multi-sided solid shape is a decadeltahedron.

31. A construction for a multi-sided solid shape as in claim 19 wherein said multi-sided solid shape is a pentagonal pyramid.

32. A construction for a multi-sided solid shape as in claim 19 wherein said multi-sided solid shape is a dodecahedron.

33. A construction for a multi-sided solid shape as in claim 19 wherein said multi-sided solid shape is a cube with square pyramids on each face.

34. A construction for a multi-sided solid shape as in claim 19 wherein said multi-sided solid shape is trapezohedron.

35. A construction for a multi-sided solid shape as in claim 19 wherein said multi-sided solid shape is a square pyramid.

36. A construction for a multi-sided solid shape as in claim 19 wherein said multi-sided solid shape is a truncated octahedron.

37. A construction for a multi-sided solid shape as in claim 19 wherein said multi-sided solid shape is a Hexagonal Tower Box.

38. A construction for a multi-sided solid shape as in claim 46 wherein said multi-sided solid shape is a Hexagonal Anti-prism.

39. A system for construction as set forth in claim 2 wherein said hidden angle locking tab and slotted flap edge-forming element comprises:

(a) a tab hingably connected to and along one free edge of said blank, which tab has a length shorter than said free edge and longer than said hinge construction;

(b) at least one rounded ear portion on said hingably connected tab;

(c) an angled fold line formed in said tab from one end of said hinge connection outward to a point on said round ear periphery such that said ear portion can be folded flat against said tab to shorten the length of said tab; and (d) a flap hingably connected to, and along another free edge of said blank, which flap has a slot formed partially along said hinge connection, and which slot has a length corresponding to the length of said tab when shortened by folding said ear so that said tab can be inserted into said slot in a folded condition and locked in place upon unfolding said ear.

40. A system for construction of a multi-sided solid shape as in claim 2 wherein said hard locking tab and slotted flap edge-forming element comprises:

(a) a tab hingably connected to and along one free edge of said blank which tab has a length shorter than said free edge and longer than said hinge connection;

(b) at least one triangular-shaped ear portion formed on said connection tab with an angled cut extending from said hinge connection to a point on the end of said tab;

(c) a fold line formed in said tab from one end of said hinge connection perpendicularly outward from said hinge to a point on the end of said tab thereby defining triangular-shaped ear portion such that said ear can be folded flat against said tab to shorten the length of said tab; and (d) a flap hingably connected co-linear with an along another free edge having a slot formed partially along said hinge connection which slot is sized corresponding to said tab when shortened by folding said ear so that said tab can be inserted into said slot in a folded condition and locked in place upon unfolding said ear.

41. A system for construction of multi-sided solid shapes as set forth in claim 1 wherein one of said tab and slotted flap edge-forming elements is a spade-tipped tab and slotted flap edge-forming element comprising:

(a) a tab hingably connected to and along one free edge of said blank;

(b) a flap hingably connected to and along another free edge of said blank, including a slit partially along said hinge connection sized for receiving said tab by insertion;

(c) a spade-shaped tip portion on said tab which tip projects outward from said hinge connection of said tab such that said tip is the first portion of said tab inserted into said slit.

42. A system for construction of multi-sided solid shapes as in claim 41 wherein said hingably connected tab on which said spade-shaped tip is formed comprises a non-locking tab.

43. A system for construction of multi-sided solid shapes as in claim 42 wherein said hingably connected tab on which said spade-shaped tip is formed comprises an angle locking tab.

44. A system for construction of multi-sided solid shapes as in claim 42 wherein said hingably connected tab on which said spade-shaped tip is formed comprises a hard locking tab.

45. A system for construction of multi-sided solid shapes as in claim 42 wherein said hingably connected tab on which said spade-shaped tip si formed comprises a forced locking tab.

* * * * *

UNITED STATES PATENT AND TRADEMARK OFFICE

CERTIFICATE OF CORRECTION

PATENT NO. : 5,253,799

DATED : OCTOBER 19, 1993

INVENTOR(S) : EDWARD H. SEBESTA

It is certified that error appears in the above-indentified patent and that said Letters Patent is hereby corrected as shown below:

Column 1, line 48, insert --have-- after "patents".

Column 1, line 50, insert --,-- after "shapes" and "cartons".

Column 2, lines 43 and 44, "parallely" is misspelled.

Column 6, line 23, replace "designs" with --design--.

Column 6, line 45, "corresponsing" is mispelled.

Column 6, line 51, insert --,-- after "numeral".

Column 8, line 1, "throughtout" is misspelled.

Page 31 of the specification is missing -- extends from Column 11, lines 58 and 59, to Column 12, line 16.

Column 11, line 67, replace "accute" with --acute--.

Column 12, line 1, replace "where" with --there--.

Column 12, line 16, replace "Preferrably", which is misspelled.

Column 12, lines 30-34, numbers were not changed per AMENDMENT AFTER ALLOWANCE UNDER 1.312.

Column 12, line 30, replace "362" with --361--.

UNITED STATES PATENT AND TRADEMARK OFFICE

CERTIFICATE OF CORRECTION

PATENT NO. : 5,253,799

DATED : OCTOBER 19, 1993

INVENTOR(S) : EDWARD H. SEBESTA

It is certified that error appears in the above-indentified patent and that said Letters Patent is hereby corrected as shown below:

Column 12, line 31, replace "364" with --363--; replace "366" with --365--.

Column 12, line 32, replace "368" with --367--; replace "370" with --369--.

Column 12, line 33, replace "372" with --371--; replace "374" with --373--.

Column 12, line 34, replace "376" with --375--.

Column 12, line 39, replace "tetrahydron" with --tetrahedron--.

Column 13, line 46, "preferrably" is misspelled.

Column 13, line 56, insert --.-- following "flaps".

Column 14, line 8, replace "bank" with --blank--.

Column 14, line 11, insert --.-- after "panels".

Column 14, line 25, replace "a)so" with --also--.

Column 15, line 35, delete "be".

Column 15, line 36, replace "conviently" with --conveniently--.

Column 16, line 8, replace "esthetically" with --aesthetically--.

UNITED STATES PATENT AND TRADEMARK OFFICE

CERTIFICATE OF CORRECTION

PATENT NO. : 5,253,799

DATED : October 19, 1993

INVENTOR(S) : Edward H. Sebesta

It is certified that error appears in the above-indentified patent and that said Letters Patent is hereby corrected as shown below:

Column 18, claim 4, line 20, insert --shapes-- before "claim".
Column 19, claim 20, line 8, replace "number" wtih --numbers--.
Column 20, claim 38, line 2, replace "46" with --19--.
Column 20, claim 39l, lines 9 and 10, replace "construction" with --connection--.
Column 20, claim 40, line 35, replace "connection" with --connected--.
Column 20, claim 40, line 44, replace "an" with --and--.
Colulmn 22, claim 45, line 5, replace "si" with --is--.

Signed and Sealed this

Sixth Day of December, 1994

*Attest:*

Bruce Lehman

BRUCE LEHMAN

*Attesting Officer*

*Commissioner of Patents and Trademarks*